US006688147B2

(12) United States Patent
Gordon et al.

(10) Patent No.: US 6,688,147 B2
(45) Date of Patent: Feb. 10, 2004

(54) PANEL CURVING MACHINE

(75) Inventors: Charles M. Gordon, La Mirada, CA (US); Bruce R. Harkness, Downey, CA (US); Daniel J. Mellough, Riverside, CA (US); Gregory Stewart, Aliso Viejo, CA (US); Vincent A. Burokas, Los Angeles, CA (US)

(73) Assignee: Ceilings Plus, Inc., Commerce, CA (US)

( * ) Notice: Subject to any disclaimer, the term of this patent is extended or adjusted under 35 U.S.C. 154(b) by 0 days.

(21) Appl. No.: 09/885,728

(22) Filed: Jun. 19, 2001

(65) Prior Publication Data

US 2003/0164021 A1 Sep. 4, 2003

Related U.S. Application Data

(60) Provisional application No. 60/212,603, filed on Jun. 19, 2000, and provisional application No. 60/245,131, filed on Nov. 2, 2000.

(51) Int. Cl.[7] ..... B21D 25/00

(52) U.S. Cl. ..... 72/15.3; 72/16.2; 72/302

(58) Field of Search ..... 72/295, 302, 303, 72/167, 177, 15.3, 16.2

(56) References Cited

U.S. PATENT DOCUMENTS

| | | | | | |
|---|---|---|---|---|---|
| 922,942 | A | * | 5/1909 | McGill | 254/100 |
| 1,015,429 | A | * | 1/1912 | Fahrney | 72/168 |
| 1,617,069 | A | * | 2/1927 | McLauglin | 72/166 |
| 1,998,509 | A | * | 4/1935 | Keith | 72/302 |
| 4,955,222 | A | * | 9/1990 | Reccius | 72/295 |
| 5,249,445 | A | * | 10/1993 | Morello | 72/129 |
| 5,359,871 | A | | 11/1994 | Morello | 36/155 |
| 5,584,198 | A | * | 12/1996 | Morello et al. | 72/10.1 |

FOREIGN PATENT DOCUMENTS

| | | | | |
|---|---|---|---|---|
| GB | 238537 | * | 2/1926 | 72/302 |
| GB | 256962 | | 2/1927 | 72/302 |
| JP | 116934 | * | 7/1983 | 72/177 |

* cited by examiner

*Primary Examiner*—Daniel C. Crane
(74) *Attorney, Agent, or Firm*—Lewis B. Sternfels

(57) ABSTRACT

A panel, formed from a perforated face (102), is respectively concavely and convexly curved by seriatim stretching or contracting its flanges (104*a, b*; 156*a, b*). Such stretching and contracting is produced by placing the opposed flanges within jaw halves (110*a, b*; 166*a, b*) of a jaw mechanism (110, 166), by seriatim positioning of the paired flanges between their respective jaw halves, and by moving the jaw halves away from or towards one another. Jaw movement towards one another effects a stretching function. Jaw movement towards one another effects a shrinking function. Computerization enables the panel curving to be precisely controlled. The curved panel, as it exits from the panel curving machine (126, 148) is supported on rollers (146) or, more precisely, by a scissor apparatus (176). The scissors apparatus includes roller sets (242, 244, 246) which are positionable, relative to one another, to conform the roller sets to the curvature of the exiting panel. The implementing mechanisms are mainly hydraulically operated.

21 Claims, 18 Drawing Sheets

114

116

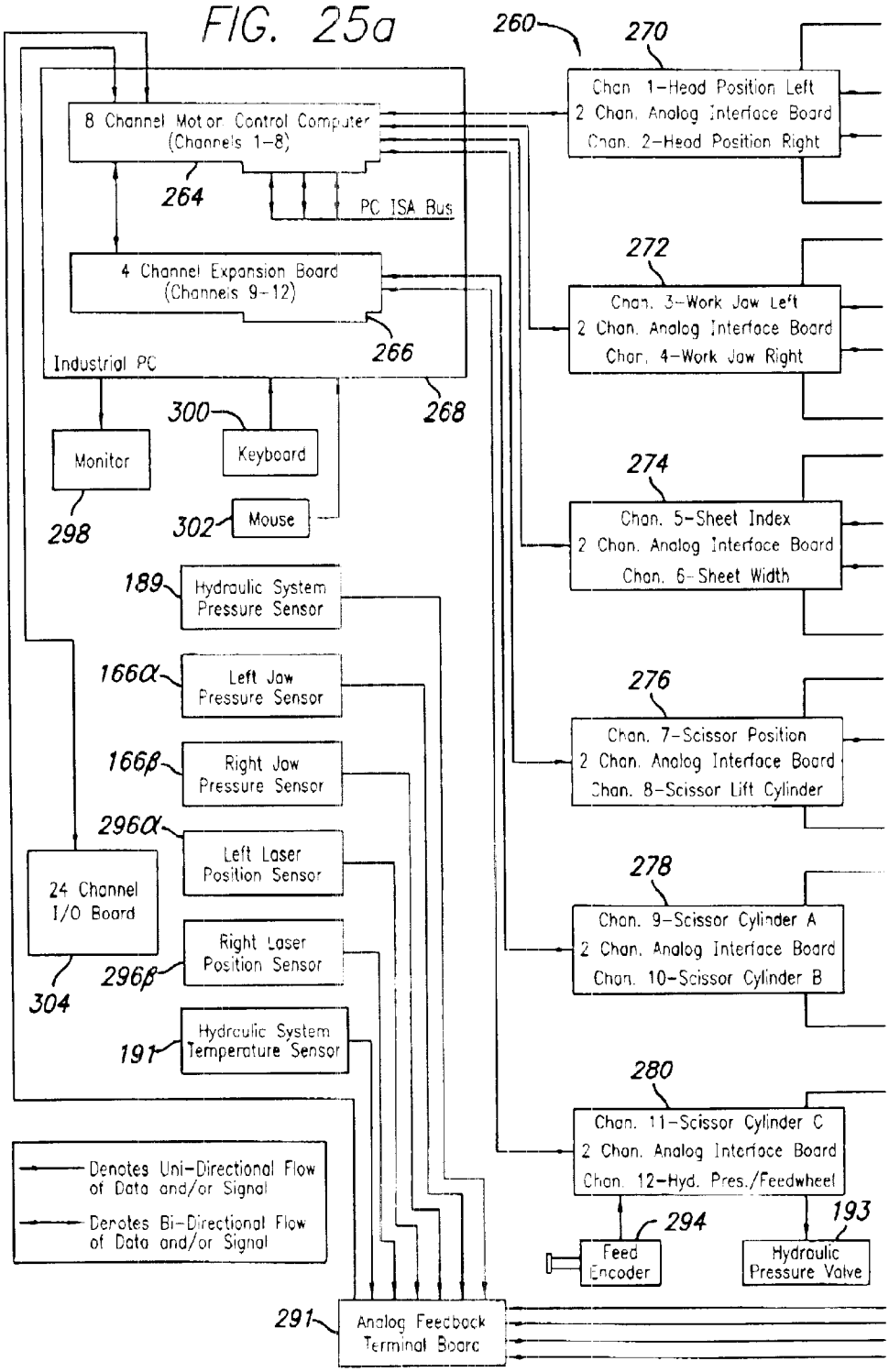
FIG. 25a
260
270
Chan 1-Head Position Left
2 Chan. Analog Interface Board
Chan. 2-Head Position Right
8 Channel Motor Control Computer
(Channels 1-8)
264
PC ISA Bus
272
4 Channel Expansion Board
(Channels 9-12)
Chan. 3-Work Jaw Left
2 Chan. Analog Interface Board
Chan. 4-Work Jaw Right
266
Industrial PC
268
300
Monitor
Keyboard
274
298
302
Mouse
Chan. 5-Sheet Index
2 Chan. Analog Interface Board
Chan. 6-Sheet Width
189
Hydraulic System
Pressure Sensor
166α
Left Jaw
Pressure Sensor
276
Chan. 7-Scissor Position
2 Chan. Analog Interface Board
Chan. 8-Scissor Lift Cylinder
166β
Right Jaw
Pressure Sensor
296α
Left Laser
Position Sensor
278
24 Channel
I/O Board
Chan. 9-Scissor Cylinder A
2 Chan. Analog Interface Board
Chan. 10-Scissor Cylinder B
Right Laser
Position Sensor
296β
304
Hydraulic System
Temperature Sensor
191
280
Chan. 11-Scissor Cylinder C
2 Chan. Analog Interface Board
Chan. 12-Hyd. Pres./Feedwheel
Denotes Uni-Directional Flow
of Data and/or Signal
Denotes Bi-Directional Flow
of Data and/or Signal
294
193
Feed
Encoder
Hydraulic
Pressure Valve
291
Analog Feedback
Terminal Board

PANEL CURVING MACHINE

CROSS-REFERENCE TO RELATED APPLICATION

This application claims the benefit of U.S. Provisional Applications, No. 60/212,603, filed Jun. 19, 2000, and No. 60/245,131, filed Nov. 2, 2000.

REFERENCE REGARDING FEDERAL SPONSORSHIP

Not Applicable

REFERENCE TO SOURCE CODE APPENDIX

Attached hereto and incorporated herein is Appendix A, which is a compact disc (CD) containing the source codes for the following language computer programs comprising the radians software (Visual Basic), the PMAC code (PMAC Basic) and the radians software installation program, which program (configure) the processors and computers disclosed herein to implement the methods and procedures described herein. The contents of the CD directory are outlined in the printed material accompanying the compact disc. These source codes are subject to copyright protection. The copyright owner has no objection to the reproduction of the appendix, as it appears in the Patent and Trademark Office patent files or records, but otherwise reserves all copyright rights whatsoever.

BACKGROUND OF THE INVENTION

1. Field of the Invention

The present invention relates to a method, and machine, apparatus and mechanisms for forming curved panels and, in particular, to improvements therein for more precisely and accurately controlling the curvature, whether convex or concave, of such panels and for improved support thereof.

2. Description of Related Art and Other Considerations

Curved panels are used for decorative and functional purposes, such as related to the construction of ceilings, walls, column enclosures and, in general, architectural skins. While such use in the construction of ceilings, walls and skins comprise the most used applications of the panels formed by the method and apparatus of the present invention, it is to be understood that other uses and applications are intended to be encompassed within the general concepts described, illustrated and claimed and, therefore, any specific application is intended to be merely illustrative of its preferred use, and not limiting as to its application.

A ceiling or wall, for example, is composed of a plurality of panels, whether curved or not, so the combination effects a decorative and/or functional result for use, for example, in small and large installations, such as homes, offices and large convention and business establishments, e.g., planetariums, museums, theaters, airports, convention centers, casinos and subway stations. Most often, such panels are perforated for sound-absorbing or acoustical purposes. They are colored, anodized or otherwise treated, for example, to provide an attractive appearance. To enhance the aesthetic appearance of the building, their curvature may be simple or complex so that, when curved or otherwise bent or arced, they bestow a collectively softened look to the interior, or even exterior if so desired, of the building and, in many cases, to form a free-flowing, undulating or simply curved effect. Light-weight metals, such as aluminum, or decorative metals, such as copper, are conventionally employed as the composition of the panels, so that they may be made larger, stronger and curvier than that previously available. When thousands or more of such panels are interconnected, suspended overhead and aligned, the result forms connecting hills and valleys in a landscape.

Such a panel used in the above-described applications and in the present invention, are formed from a flat, perforated blank. The blank may have any geometrical shape, e.g., triangular, rectangular or other configuration. It is cut away at its corners, or wherever suitable. In the case of a rectangularly shaped blank, the four corners are cut away so that their circumferential edge portions can be bent to form an interior face and flanges angularly extending therefrom. If all four flanges of a rectangularly shaped blank were bent, they could be made to meet and thus to form an enclosing border.

In panels previously marketed by the assignee of the present invention and fabricated by use of machines and methods not publically disclosed or otherwise made publically known until divulged herein, the bending of such rectangularly shaped blanks was performed in a two-step operation. The first bending entailed the bending first of opposed parallelly disposed flanges extending longitudinally along the interconnecting perforated interior face or portion into an angled orientation from the perforated panel face. These parallelly extending flanges were then stretched or shrunk, that is dimensionally changed, in sequential fashion along their lengths extending along the corresponding longitudinal dimension of the panel in construction. Such stretching or shrinking exerted stresses on the face of the blank so as to bias the face in a curved fashion. A stretching of the flanges produced a panel being concavely configured. A shrinking of the flanges produced a panel being convexly configured. Thereafter, the remaining flanges were bent to form a border enclosing a perforated interior portion or face which is either concavely or convexly curved, in accordance with the stretching or shrinking of the parallelly extending flanges. Brackets of conventional construction were then secured to selected ones of the flanges to enable the panels to be hung.

The machines and methods, which are referred to above as not having been publically disclosed or otherwise made publically known, employ two stretching and shrinking mechanisms, one for each flange. Each mechanism includes paired opposing jaws positioned on either side of its panel flange, and the jaws are disposed to grip the flange segment sandwiched therebetween. Each jaw mechanism is supported on a head, and one of the shrinking or stretching jaws is moveable while the other is stationary during the stretching or shrinking operation. The heads are moveable with respect to one another only to accommodate different panel widths between the panel flanges and, when so accommodated, are fixed in place.

The preferred jaw mechanisms are fabricated by W. Eckold AG Werkzeugmaschinen of Switzerland and are described in its forming tools and spare parts brochure entitled "Eckold-Kraftformer Piccolo, KF 320, KF 314", pages 6–8 thereof relating to spare parts FWA and FWR. In the preferred mechanisms, each jaw is composed of a pair of jaw halves, and one pair of jaw halves is positioned on one side of the flange and the other pair of jaw halves is positioned on the other side of the flange. This arrangement may be termed a sandwich of a flange segment between opposing jaw halves. Each pair of jaw halves is so constructed that the jaw halves within each pair can move mutually either towards or away from one other in a plane which is essentially parallel to the surfaces of the segment of the panel flange. Such relative movement between the jaw halves is dependant upon the configuration of the jaw half driving components which are coupled to a hydraulically operated driver. The jaw driving components include camming type elements which provide a very small and limited lateral movement of one pair of jaw halves in one jaw mechanism from the mating pair of jaw halves in the other jaw mechanism. This very small lateral jaw movement permits the panel flanges to be moved from one stretching or shrinking operation to the next such operation on an adjacent panel flange segment. Due to reasons discussed below, such lateral jaw movement is often insufficient to avoid some contact between the stationary jaw member and the adjacent flange surface. Additional lateral movement of the other jaw mechanism, when it is moved away from the stationary jaw mechanism, avoids contact the its adjacent flange surface.

In operation, when the jaw halves of opposed mechanisms engage opposite sides of the segment of the flange, the thus engaged flange segment is either shrunk or stretched.

The machines and methods, which are referred to above as not having been publically disclosed or otherwise made publically known, also include panel supporting and incrementally moving rollers. These rollers respectively support and grip the panel being worked on so as to incrementally move it and its flange portions into a stationary position between the jaws for stretching or shrinking a specific panel flange portion presently positioned between the jaws, and then to incrementally advance the panel so as to position the next panel flange portion to be so worked on.

Further support is employed to support the completed, curved panel as it exits from the machine, comprising essentially a linearly disposed roller arrangement positioned generally at the center of the panel face.

While the curved panels so fabricated have been successfully accepted and served well for their intended applications, it was desired that the curvature and quality of the finished product be improved. If the sequentially applied stretching or shrinking operations were not perfectly applied to the flanges, either to an individual flange or to opposed flanges, variations in curvature occurred, resulting in a non-uniform or warped panel appearance.

It was also discovered, for example, that the blanks, per se as constituting the raw material for the panels, were not homogeneous in several respects, that the panels were not uniformly shaped, and/or that the panel flanges were galled. Lack of homogeneity resulted from varying physical, chemical and material characteristics, for example, nonuniform thickness, material constituents and hardness throughout the blanks. Formation of the panel flanges also produced a lack of uniformity, e.g., from slight variations in the thickness of the flange when the blank was first fabricated from sheet stock, or from slight variations in the flatness of an individual flange or in the parallelism between the flanges on opposite sides of the perforated panel face, such as might have occurred during bending of the blank to form the dependent flanges. These and possibly other reasons produced galling in the flanges due to abrasion as they were moved past one or both the jaws because the lateral movement of the jaw half pairs was insufficient to provide adequate clearance of one or both jaw halves in one or both of the jaw pair from one or both the surfaces of the respective panel flange. Most commonly, the advancing panel would cause one side of the flange to contact the stationary jaw halves. The curvature of the finished panel was also affected by all or part of the above lack of homogeneity and uniformity.

The support provided by the essentially linearly disposed roller device means positioned at the exit of the machine was found not to be completely successful, in part because the exit portion of the curving machine acted as a fixed central point for holding the exiting curved panel. Therefore, as the panel moved further from the machine, this fixed point acted to increasingly produce a cantilevering effect on the curved panel. The linearly disposed roller support positioned at the center of the perforated panel face mitigated, but did not completely avoid such a cantilevering effect, and was further found to provide inadequate support for the panel, particularly at its face adjacent the side flanges. As a consequence, the curvature of the panel was deleteriously affected to a lesser or greater extent.

Therefore, every finished panel needed to be inspected for damage or lack of uniform curvature and, regarding the latter issue, the panels had to be segregated into like groups or classes and, when often needed, reworked by hand. Such inspection and reworking by hand involves the placing of the curved flange over a printed pattern of the desired curvature, to match the former with the latter. If there is a mismatch, the mismatch is marked on the flange, and the flange is inserted into a manually operated crimping tool, and crimped. Further inspection and manual crimping is conducted, as required. The result is increased cost and lower profitability, and affected competition vis-a-vis the products of others.

SUMMARY OF THE INVENTION

The machines and methods, which are referred to above as not having been publically disclosed or otherwise made publically known, are improved upon by the addition of refinements and additions which monitor and support the panel as it is worked on and protect it from undesired physical contact. A computer and related software, coupled to appropriate fluidic, mechanical, electromechanical and opto-mechanical devices ensure proper control of the refinements and additions.

Specifically, the curvature of the panel, as it is worked on by the stretching or shrinking mechanisms, is monitored preferably by a laser radiation so that any variation from the desired curvature pursuant to a pre-existing specification is immediately detected and information thereof is fed to the computer which then commands the respective stretching or shrinking mechanism and the panel feeding apparatus to make appropriate corrections. Both the heads, which carry the jaw mechanisms, and the jaw mechanisms are moveable towards and away from one another in individual and collective deportment to provide better spacing between the jaw mechanisms and, therefore, to avoid such problems which result from galling and abrasion and less than desired uniformity of panel curvature.

Several advantages are derived from this arrangement. Primarily, the curvature of the panels is more accurate and uniform. Panel face imperfections are reduced, the panel has the look of a true curve and the panel's appearance is accordingly improved. The points at which the curvature can be stopped and started can be more precisely located and, therefore, the transition from one curve to another, e.g., concave to convex and vice-versa or to a flat, is easily attained; one curve producing jaw mechanism can be replaced by another with much greater ease than before. Only inspection for lack of homogeneity and machine settings, for example, is required; inspection for galling is eliminated. Because the lack of uniform curvature is essentially, if not substantially avoided, less or no segregation of the panels into like groups or classes is circumvented. Costs are better maintained, architectural precision is enhanced, and increased acceptance in the marketplace is attained.

Other aims and advantages, as well as a more complete understanding of the present invention, will appear from the following explanation of exemplary embodiments and the accompanying drawings thereof.

BRIEF DESCRIPTION OF THE DRAWINGS

FIG. 21(*a*) depicts the scissors mechanism in its extended or deployed position in readiness to support a panel. FIG. 21(*b*) depicts the scissors mechanism in its retracted or folded position.

FIGS. 25*a* and 25*b* depict respective halves of an electrical connection diagram operable to control the embodiment illustrated in FIGS. 14–21*b*.

DETAILED DESCRIPTION OF THE PREFERRED EMBODIMENTS

FIGS. 1–4 depict a typical panel which is appropriately imparted with a concave or convex configuration as illustrated by the methods and apparatus briefly outlined in FIGS. 5–10. For purposes of exposition, a rectangularly shaped blank, which is disposed to be configured into a rectangularly shaped panel, will be described, although it is be understood that other geometrical shapes may also be operated upon.

Figure 1:
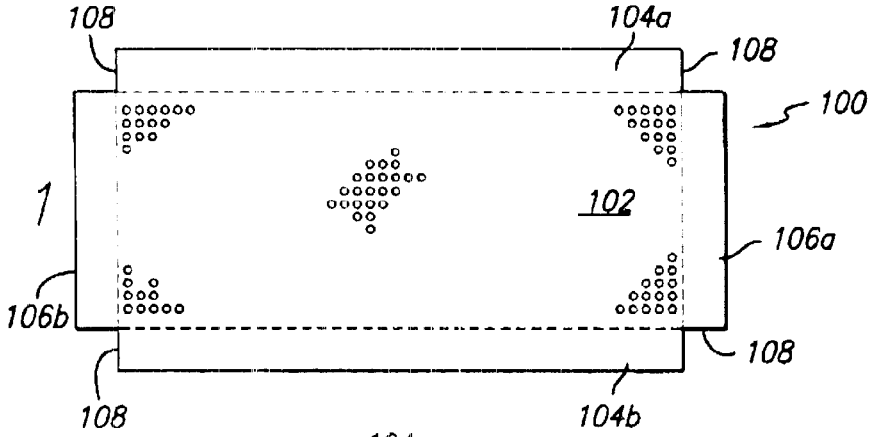
FIG. 1 is a view of a rectangular blank of a panel comprising a central face portion and shorter and longer pairs of parallelly extending side portions which are disposed to be later bent into flanges.

Specifically, as depicted in FIG. 1, a blank 100, which is to be fabricated into a panel, includes a central perforated portion or face 102. Perforated face 102 is bounded on its four sides by two pairs 104 and 106 of edge portions comprising longer parallelly extending portions or incipient flanges 104*a* and 104*b* and shorter parallelly extending portions or incipient flanges 106*a* and 106*b*. The intersecting corners between the portions are cut away as designated by indicia 108 to enable the portions to be later bent into contact with adjacent portions to form a panel with enclosing flanges.

Figure 2:
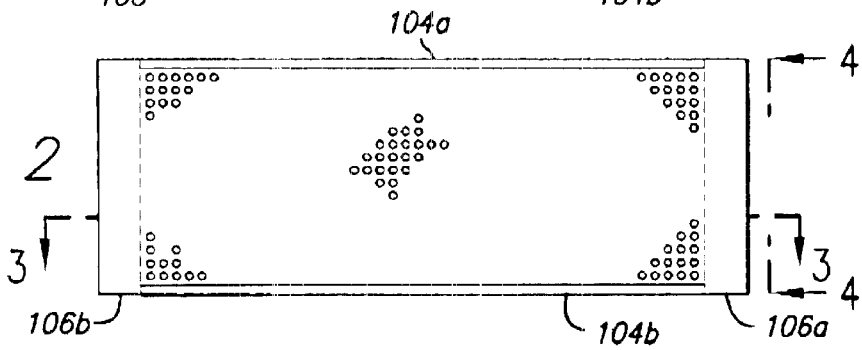
FIG. 2 is a view similar to that shown in FIG. 1, showing its longer side portion having been bent at right angles to the face portion to form a pair of parallelly extending flanges.
Figure 3:
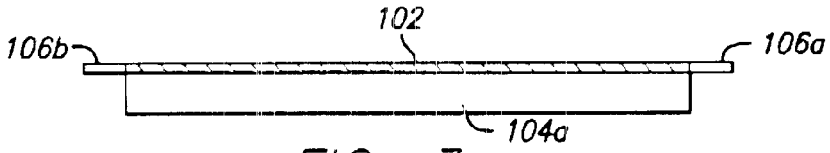
FIG. 3 is a view of the panel illustrated in FIG. 2 taken along line 3—3 thereof.
Figure 4:
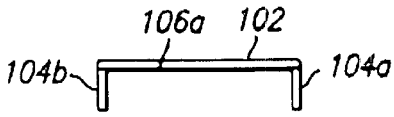
FIG. 4 is a view of the panel illustrated in FIG. 2 taken along line 4—4 thereof.
Figure 8:
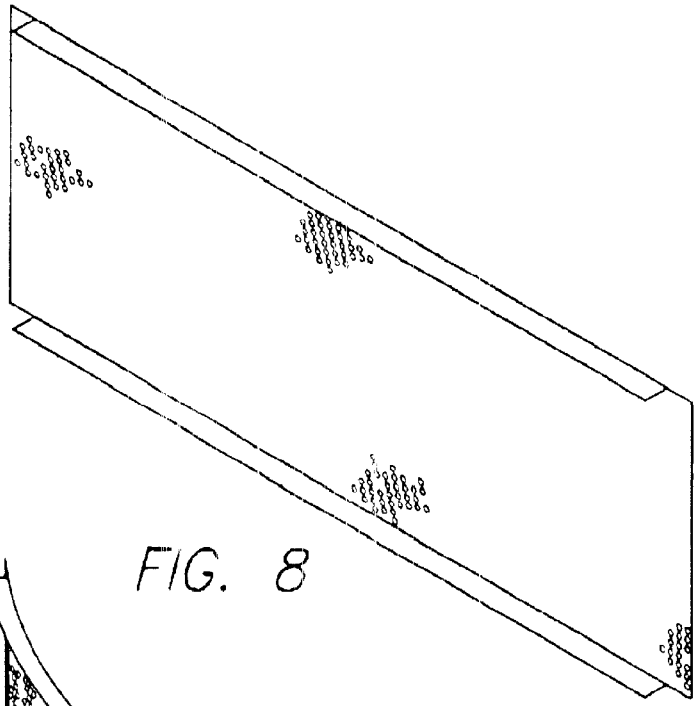
FIG. 8 is a perspective view of an exemplary panel, prior to its being curved, such as shown in FIGS. 2–4.

Blank 100 is first operated upon by bending portions 104*a* and 104*b* into flanges which are thus disposed at an angle of about 90° from face 102, as shown in FIGS. 2–4 (see also FIG. 8). In this example, flanges 104*a* and 104*b* are arranged to be stretched or shrunk to impart the desired concave or convex curvature to the panel between shorter parallelly extending portions or incipient flanges 106*a* and 106*b*.

Figure 5:
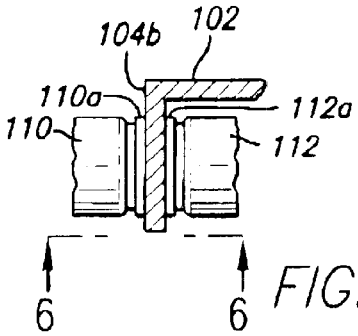
FIG. 5 is a view (a) in cross-section of a segment of the panel depicted in FIG. 4, and (b) in full of a pair of jaw mechanisms which are in contact with the inner and outer surfaces of one of the flanges and which are configurable either as a flange stretching or a flange shrinking device.
Figure 6:
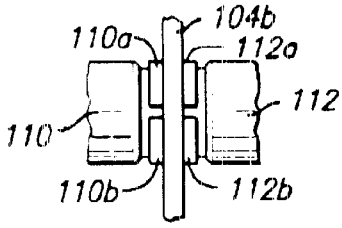
FIG. 6 is view of the panel flange and jaw mechanism of FIG. 5 taken along line 6—6 thereof, and shows a pair of relatively movable jaw halves.

Accordingly, as illustrated in FIGS. 5 and 6, each flange, as exemplified by flange 104*b* is positioned between a pair of jaw mechanisms 110 and 112 (see also FIG. 32 which shows the jaw mechanisms per se without a panel flange positioned between them). Each jaw mechanism includes a pair of jaw halves 110*a*, 110*b* and 112*a* and 112*b*, which are arranged to move either away from or towards each other, as respectively illustrated in FIGS. 6*a* and 6*b*. Such relative movement between the jaw halves is dependant upon the configuration of the jaw half driving components which are coupled through camming-type elements to a hydraulically operated driver.

When jaw halves 110*a*, 110*b* and 112*a* and 112*b* of opposed mechanisms 110 and 112 engage opposite sides of the portion or segment of the flange, the thus engaged flange segment is either shrunk or stretched. The preferred mechanisms, are fabricated by W. Eckold AG Werkzeugmaschinen of Switzerland as referenced above, viz., they are described in its forming tools and spare parts brochure entitled "Eckold-Kraftformer Piccolo, KF 320, KF 314," pages 6–8 thereof relating to spare parts FWA and FWR.

Figure 6A:
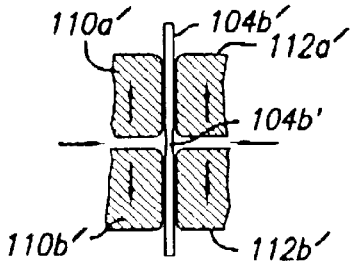
FIGS. 6*a* and 6*b* respectively exhibit the operation of flange stretching and shrinking mechanisms.
Figure 6B:
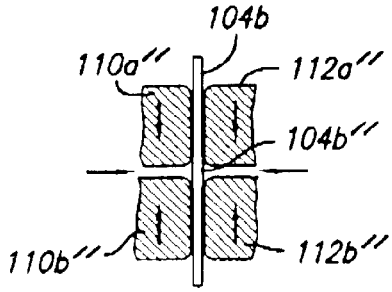

The stretching operation is depicted in FIG. 6*a* in which respective jaw halves 110*a', b'* and 112*a', b'* are caused to move away from one another to cause a segment 104*b'* to stretch. The shrinking operation is depicted in FIG. 6*b* in which respective jaw halves 110*a", b"* and 112*a", b"* are caused to move away from one another to cause a segment 104*b"* to stretch.

Figure 7A:
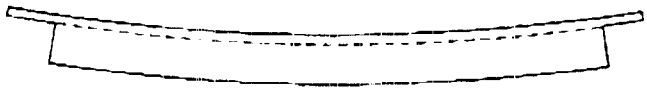
FIGS. 7*a* and 7*b* respectively depict concavely and convexly shaped panels, as curved by the repeated operation of the respective flange stretching and shrinking mechanisms illustrated in FIGS. 6*a* and 6*b*.
Figure 7B:
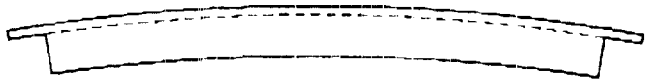
Figure 9:
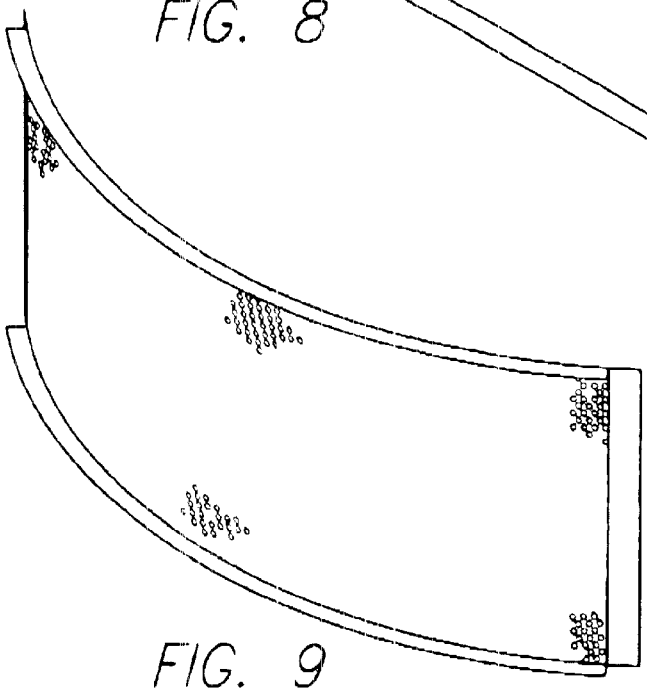
FIG. 9 is a perspective of another exemplary panel, after having been concavely curved, such as shown in FIG. 7*b* after its flanges were subjected to stretching.
Figure 10:
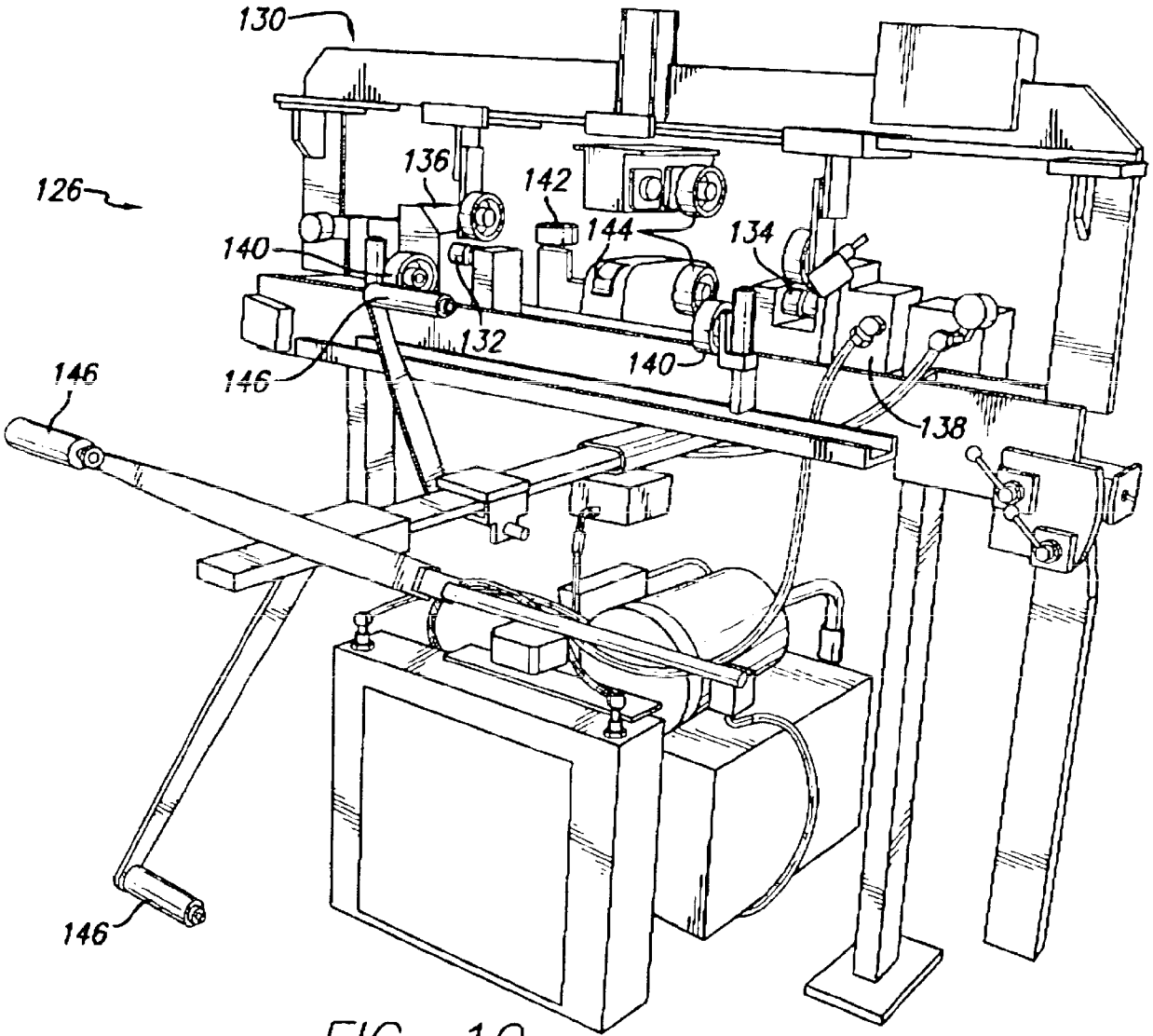
FIGS. 10–13 are perspective views of a machine, which is referred to above as not having been publically disclosed or otherwise made publically known. The FIG. 10 perspective views the back of the machine from which a panel will exit after having been curved. The FIG. 11 perspective is a front-side to back-side view into which front-side a panel is placed for feeding into the curve forming devices. The FIG. 12 perspective is a view of one side of the machine. The FIG. 13 perspective of the machine viewed from the side opposite from that taken in FIG. 12 and looking towards the rear part or facade of its back-side.
Figure 11:
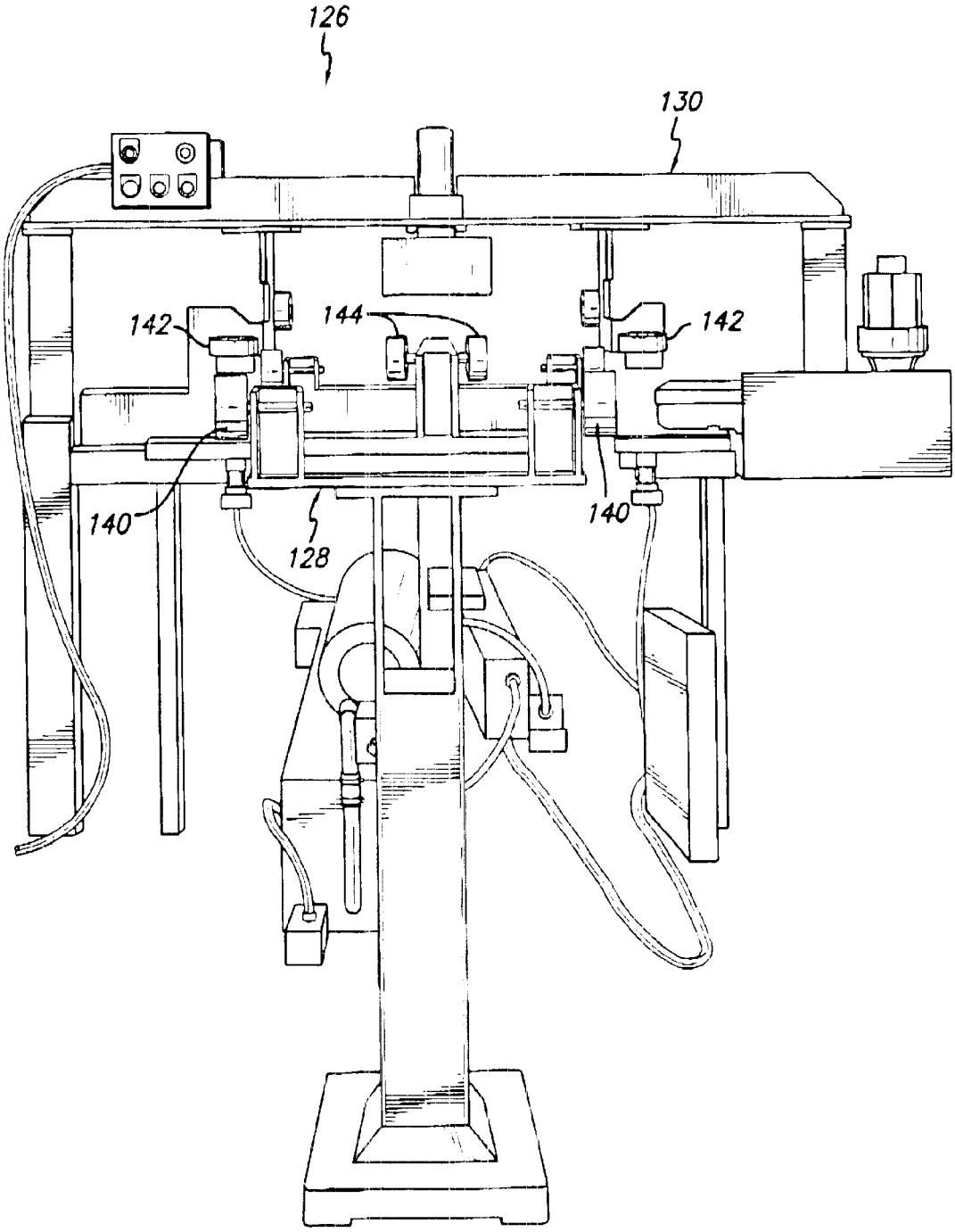
Figure 12:
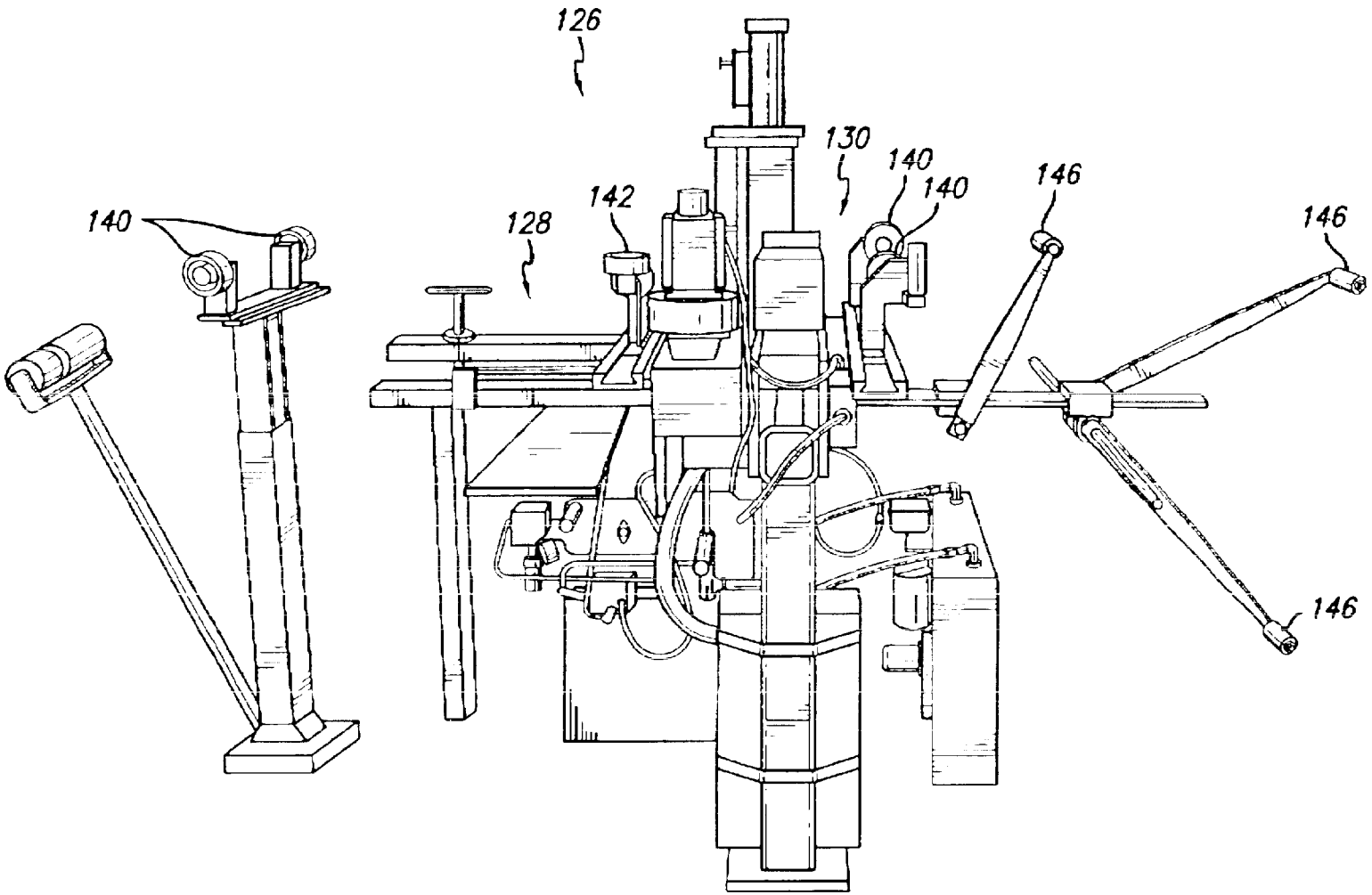
Figure 13:
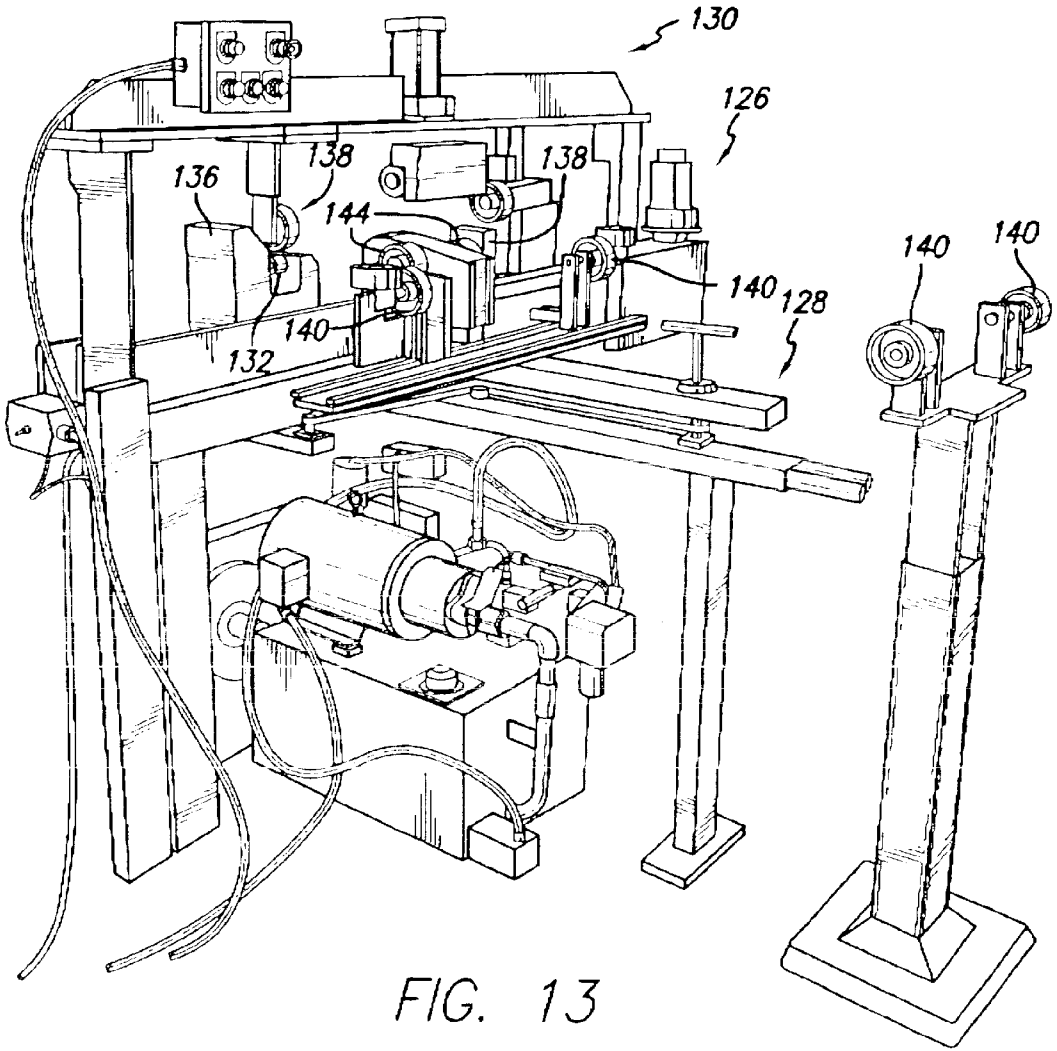

By seriatim application of these respective stretching and shrinking operations on spaced segments of the flange, as the panel is advanced past the opposing jaw halves, the entirety of both, parallelly extending flanges will be stretched or shrunk to an extent in accordance with the aggregate stretching or shrinking. This results, as shown in FIGS. 7*a* and 7*b*, in a concavely shaped panel 114 having a like shaped perforated face 116 and a convexly shaped panel 118 having a like shaped face 120 effected by their respectively stretched-segment and shrunken-segment flanges 122 and 124. FIG. 9 is a perspective view of a concavely curved panel and which may be further processed to incorporate downwardly bent shorter portions formed from end flanges 106*a* and 106*b* and hanger hardware attached to the longer flange pair to enable the panels to be appropriate hung, for example, from a ceiling.

In FIGS. 10–13, a machine 126 used to fabricate curved panels includes a front-side section 128 into which panels are inserted and a back-side section 130 from which the curved panels exit. Two pairs of jaw mechanisms 132 and 134 are supported on heads 136 and 138 on back-side section 130. For purposes of discussion at this point, the jaw mechanisms will not be classified as being of the stretching or the shrinking variety, unless a specific reference to one or the other is required to distinguish between a concavely or a convexly curved panel.

Vertically disposed panel supporting rollers 140 on both the front-side and back-side portions are arranged to contact the upper and under sides of the panel face. Horizontally disposed panel flange guiding rollers 142 on the back-side portion 130 are arranged to guide the panel through flange jaw mechanisms 132 and 134. Additional vertically disposed panel advancing or indexing paired rollers 144 are positioned in the back-side section and are arranged to frictionally engage the upper and lower surfaces of the panel face so as to index the panel and, in particular, the parallelly placed panel flanges in indexed seriatim through the jaws of each mechanism 132.

A linearly disposed roller means 146 is positioned adjacent back-side section 130 and is employed to support the center of the completed, curved panel as it exits from the machine.

Figure 14:
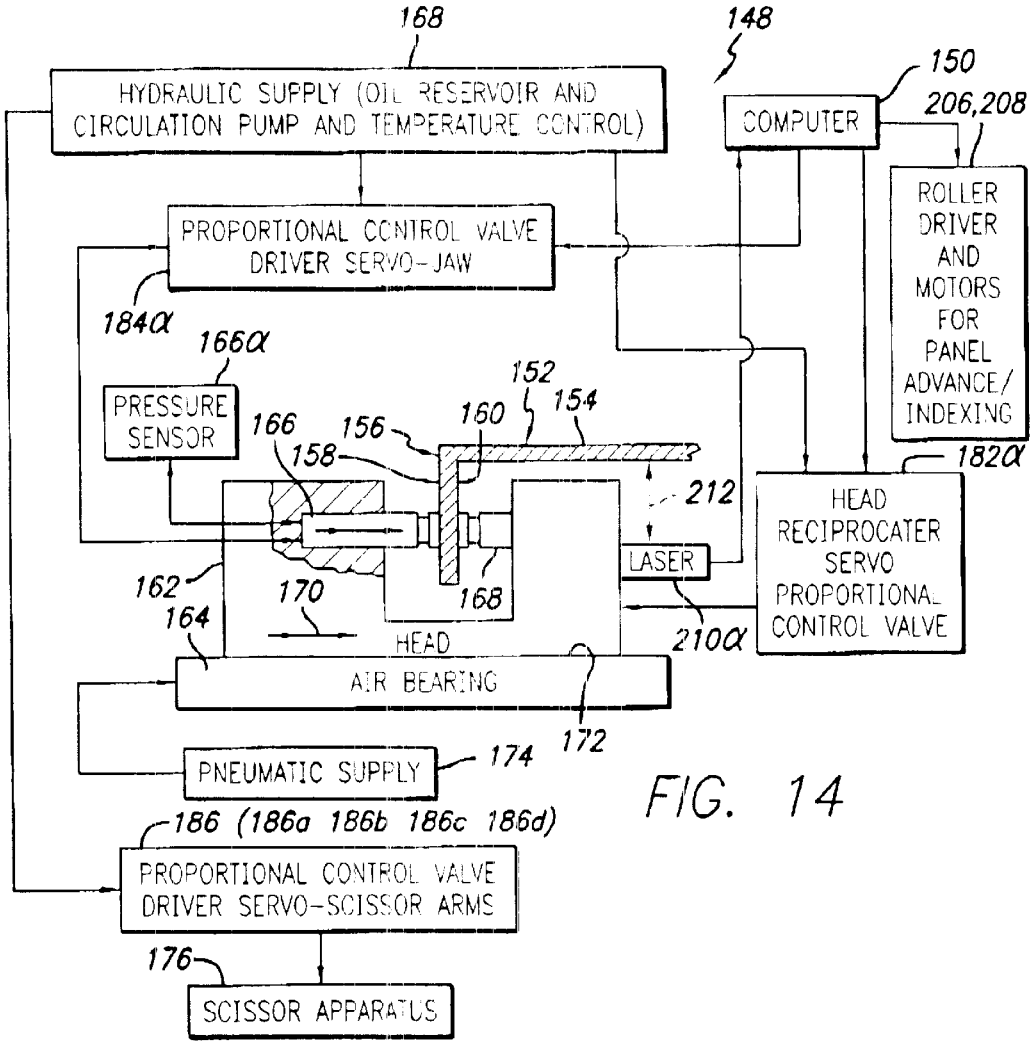
FIG. 14 is a block diagram of the improved machine, panel supporting scissors apparatus, computer and supporting equipment therefor, including pneumatic and hydraulic supplies. Further included is laser radiation inspection of the panel in process of being curved to ensure improved curvature.
Figure 15:
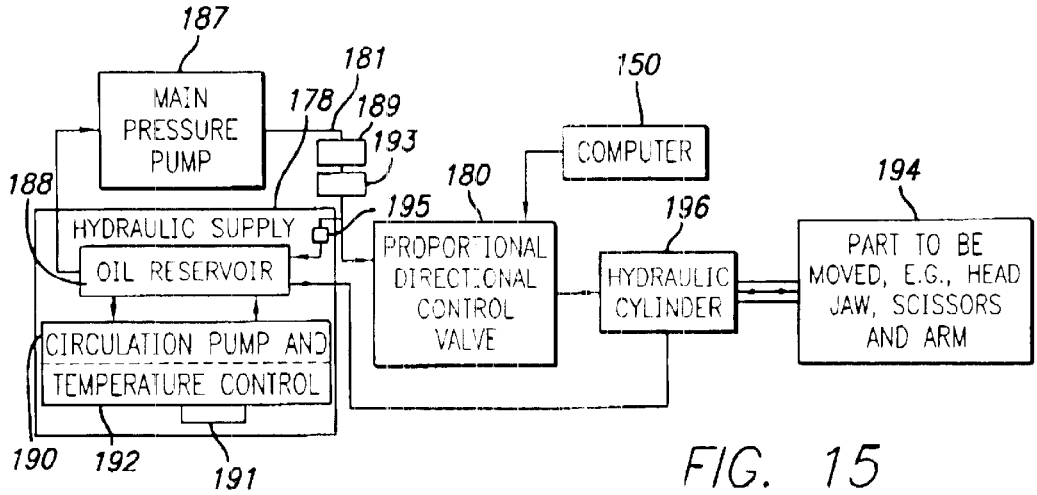
FIG. 15 is a block diagram of the hydraulic supply used in the various apparatus encompassed by the circuit diagram of FIG. 14.

FIGS. 14 and 15 depict, in block diagram, an improved curving machine 148, which is controlled by a computer 150. Machine 148 is designed to accurately curve a panel, as represented by panel portion 152 having a perforated face 154 and a flange 156 depending from the perforated face. Flange 156 includes parallelly and longitudinally extending surfaces 158 and 160.

Figure 22:
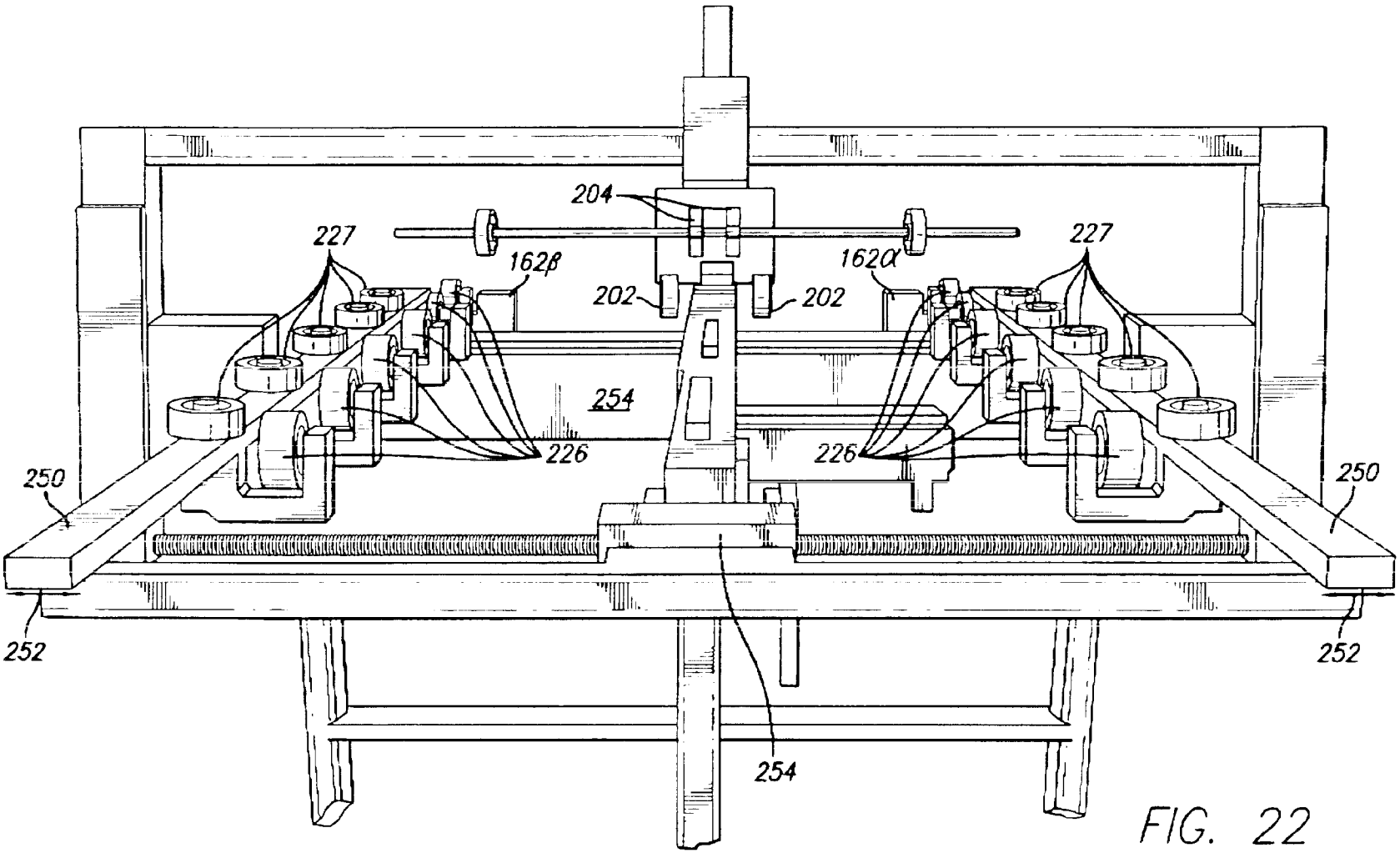
FIG. 22 is a view of one embodiment of the improved panel curving machine, exemplified as an enablement incorporating the block diagram configuration depicted in FIG. 14.

The entirety of improved computer-controlled machine 148 is illustrated in FIG. 22 et seq., which machine includes two heads supporting jaw mechanisms and a centrally placed panel advancing/indexing roller mechanism, FIG. 14 depicts one side of machine 148.

As viewed in FIG. 14, and the orientation of broken-away perforated face 154 of panel portion 152, FIG. 14 may be viewed as the left-hand side of the panel curving machine, as distinguished from its right-hand side. This "left-hand" side comprises one head and its jaw mechanism and supporting hardware as being representative of its mating head and its jaw mechanism on the other side. Accordingly, for simplicity of the following exposition, FIGS. 14–17 illustrate a single device or mechanism, which is representative of the "right-hand" side of machine 148.

Notwithstanding the immediately preceding introduction relating to the simplified depiction of the machine, because the description of the electrical connection and the input/output diagrams shown in FIGS. 25*a*, 25*b*, 26*a* and 26*b* describe some components which pertain to both heads and their jaw mechanisms, the indicia employed in the subsequent description for certain components are further labeled with the Greek letters "α" and "β". Consequently, any indicium having the appendage "α" pertains to the "left-hand" side of the machine, while any indicium having the appendage "β" pertains to the "right-hand" side. For convenience, when it is not necessary to make a distinction between the left-half side "α" and the right-hand side "β", these appendages may be omitted; however, it is be understood that they pertain, when apposite.

Accordingly, improved computer-controlled curving machine 148 includes a pair of generally configured U-shaped heads 162α and 162β (generically identified by indicium 162) supported on an air bearing 164, and a pair of jaw mechanisms 166 and 168 carried by the head. Head 162 is reciprocable, as denoted by double-headed arrow line 170, on an appropriate base 172, and its frictional engagement therewith is limited by air bearing 164, which is coupled to a pneumatic supply 174. A supporting scissors apparatus 176 is positioned at the back-side section of the curved machine for receipt of the curved panel.

As depicted in FIG. 15, a hydraulic system provides the instrumentality for operating all movable components, such as head 162, jaw mechanism 166, and scissors apparatus 176. Specifically, the hydraulic system includes a supply 178 of hydraulic fluid, such as oil, which is furnished to the several proportional directional control valves, typified by indicium 180 in FIG. 15, for operating the several components, viz., proportional directional control valve 182 for head 162, proportional directional control valve 184 for jaw mechanism 166, and proportional directional control valve 186 for scissors apparatus 176. A preferred typical proportional directional control valve comprises a high response proportional servo valve with an on-board drive amplifier, e.g., U.S. Pat. No. 4,434,966 and related patents.

As also shown in FIG. 15, hydraulic fluid supply 178 includes a main pressure pump 187, an oil reservoir 188, a circulation pump 190 and a temperature control 192. Main pressure pump 187 is connected to proportional directional control valve 180 through a line 181. Temperature control 192 is coupled to circulation pump 190 to ensure a proper temperature of the oil to be supplied to proportional directional control valve 180. A hydraulic system temperature sensor 191 is associated with temperature control 192 to sense the temperature of the hydraulic fluid. Proportional directional control valve 180 is coupled to the device or mechanism (generally designated by indicium 194) to be moved, e.g., head 162, jaws mechanism 166 and scissors apparatus 176, through a hydraulic cylinder 196 of conventional design. A hydraulic system pressure sensor 191 and a hydraulic pressure valve 193 are placed in line 181 from main pressure pump 187 to proportional directional control valve 180.

A pressure bypass valve 195 is included between line 181 and oil reservoir 188 to allow the system to operate at very low pressures in order to achieve a gentle curving effect or for use with soft and or thin materials.

Figure 16:
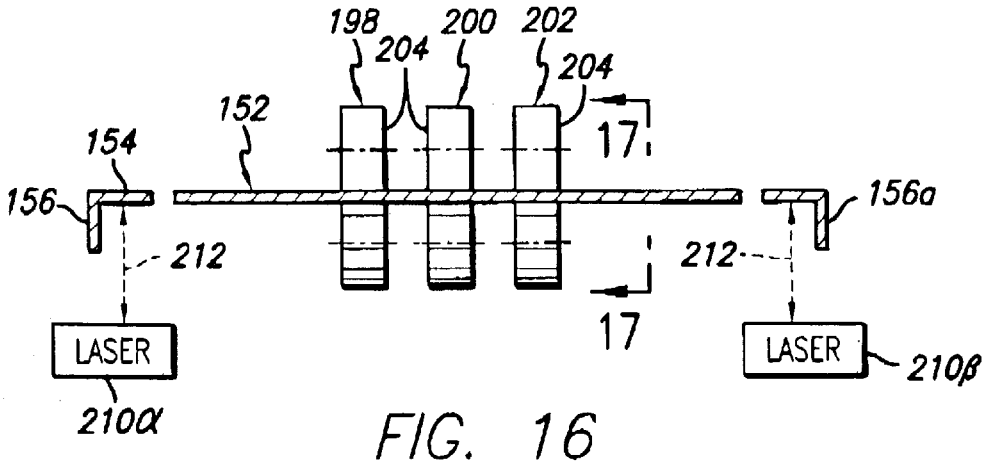
FIGS. 16–18 depict the advancing or indexing rollers and mechanisms and apparatus for advancing or indexing the panel and its dependent flanges for stretching or shrinking by the jaw mechanisms, with FIG. 17 being taken along line 17—17 of FIG. 16.
Figure 17:
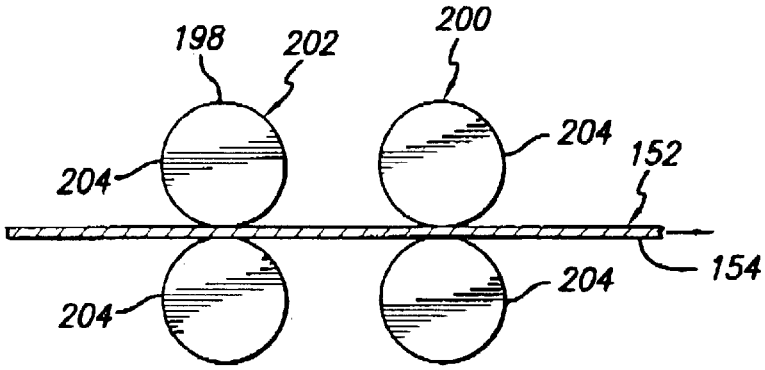
Figure 18:
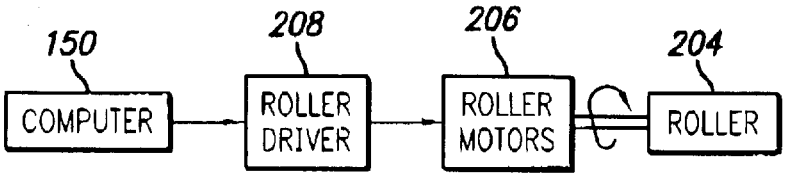

As illustrated in FIGS. 16–18, panel 152 is advanced or indexed through computer-controlled curving machine 148 preferably by three pairs 198, 200 and 202 of six motor-driven rollers 204 which are grouped in three pairs to provide a proper gripping of perforated face 154 of panel 152. Rollers 204 are driven by roller motors 206, as controlled by an electronic roller driver device 208 which, in turn, is controlled by computer 150.

A laser device 210, one for each head (see also FIG. 16), provides radiation 212 directed at panel perforated face 154 adjacent to flanges 156 and 156*a*. Such radiation provides information of the curvature of the panel, and such information is directed to computer 150 for such corrective action as may be required, pursuant to a comparison between the information thus obtained with a pre-established specification.

In general, computer 150 is coupled to proportional directional control valves 170, 172 and 174 through appropriate circuitry to actuate them in accordance with the directions both for ensuring the proper settings in curving machine 148 and scissors apparatus 174, as specified for the particular panel to be processed, and for otherwise operating the curving machine.

Figure 19:
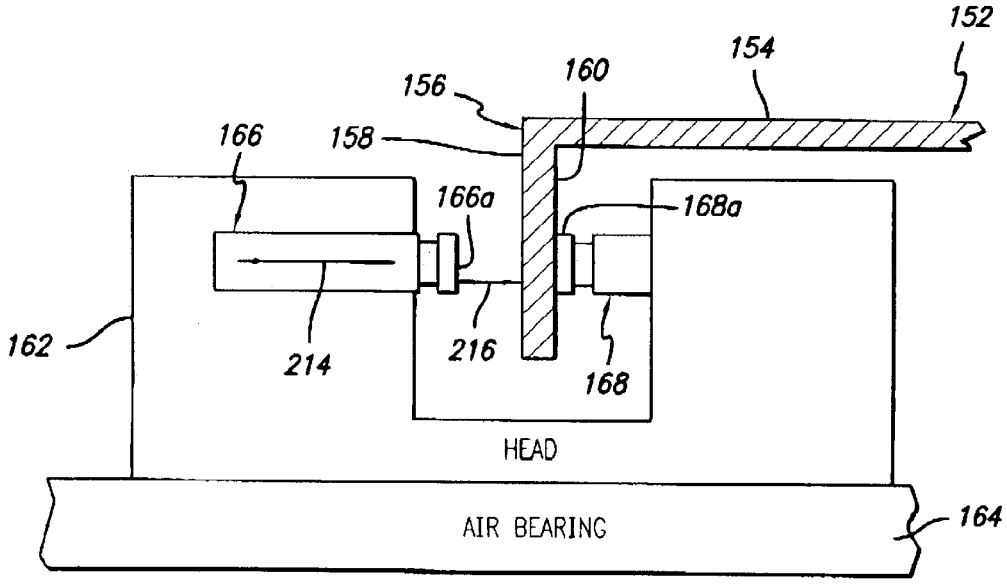
FIGS. 19 and 20 illustrate the positioning of one of the two panel flange stretching/shrinking jaw mechanisms and their supporting heads for ensuring indexing of the panel without galling to the flanges.
Figure 20:
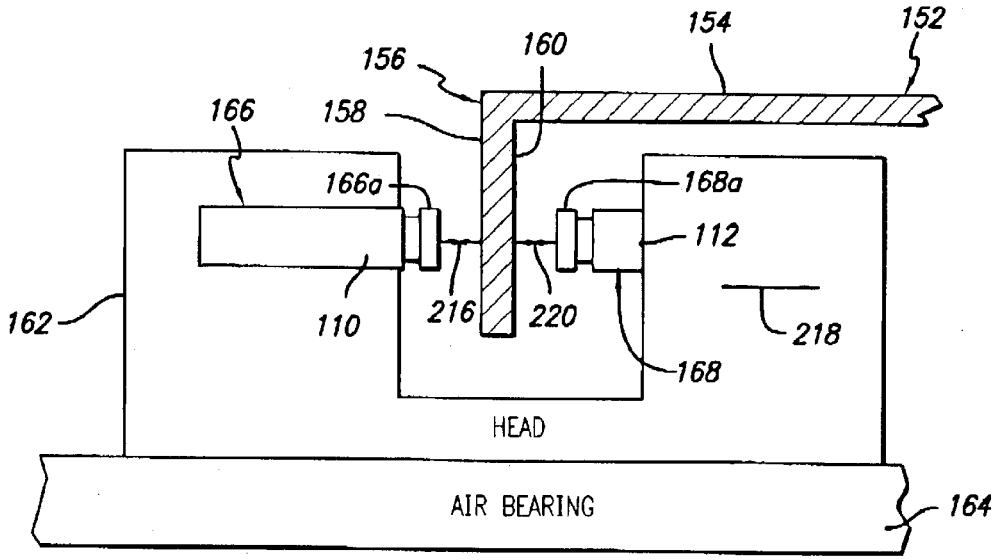

One computer-controlled operation is illustrated in FIGS. 14, 19 and 20 with respect to the head and jaw mechanism movements, and in conjunction with the advancing and indexing of the panel by roller pairs 200–204 and the diagram shown in FIG. 18. The position of panel flange 156 in FIGS. 14 and 14*a* and, in particular the segment of its segment gripped between movable jaw mechanism 166 and fixed jaw mechanism 168, is after the panel segment has been stretched or shrunk. The indicia adopted to identify the jaw halves of jaw mechanisms 166 and 168 follow that used with respect to FIG. 6; thus, jaw halves 166*a, b* correspond to jaw halves 110*a, b* and jaw halves 168*a, b* correspond to jaw halves 112*a, b*.

Figure 14A:
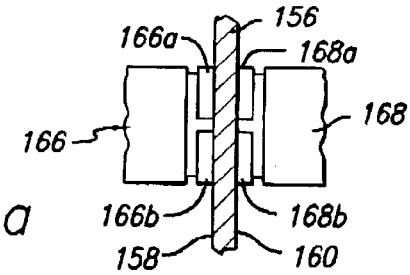
FIG. 14*a* is a view of the jaw mechanisms depicted in FIG. 15, but taken orthogonally thereto, similarly as FIG. 6 is a 90° view of FIG. 5 taken along line 6—6 thereof, also to show a pair of relatively movable jaw halves.

It is then necessary to advance or index the panel, without galling or otherwise harming the flange, so that the adjacent flange segment may be in position to be appropriately stretched or shrunk. The steps taken to effect this advance/indexing phase from the position shown in FIGS. 14 and 14*a* is illustrated in FIGS. 19 and 20. As shown in FIG. 19, jaw mechanism 166 is retracted, as illustrated by the movement designated by line 214 in the direction of its arrowhead, to pull jaw halves 166*a* and 166*b* from contact with flange surface 158, the separation therebetween being designated by double-headed arrow indicium 216. Jaw mechanism 168 remains stationary.

Then, as shown in FIG. 20, head 162, and both jaw mechanisms 166 and 168, are linearly moved as illustrated by the movement designated by line 218 in the direction of its arrowhead, to pull jaw halves 168*a* and 168*b* from contact with flange surface 160, the separation therebetween being designated by double-headed arrow indicium 220. In this phase, both jaw mechanisms 166 and 168 remain stationary with respect to head 162, but move together therewith. This movement reduces the separation designated in FIG. 19 by indicium 216 between jaw halves 166*a* and 166*b* and flange surface 158 by a smaller separation, which is designated by double-headed arrow indicium 216' to differentiate it from larger separation 216. The only condition placed upon the dimension of separation 216 is that it be of sufficient magnitude that, after movement of head 162, both jaw halves 166*a, b* and 168*a, b* remain out of contact with surfaces 158 and 160 of flange 156, regardless of any irregularity in the continuity of the flange.

After completion of the movements described with respect to FIGS. 19 and 20, panel 152 is indexed to its next position to place a new segment of the flange between the jaws for repeated stretching or shrinking.

During the movements described in connection with the movement depicted in FIGS. 14*a*, 19 and 20, both lasers 210 also monitor the curvature of panel 152, specifically of its perforated face 154 adjacent its opposed flanges 156 and 156*a*. The laser radiation reflections from the panel face are conveyed to computer 150, and compared with the desired curvature specification information stored therein to provide corrective information. This corrective information is then directed to the respective proportional directional control valves, e.g., valve 182, to regulate the amount of movement of reciprocable jaw mechanism 166 towards the flange segment to be stretched or shrunk for a predetermined distance. This movement of reciprocable jaw mechanism 166 and the extent of its predetermined distance, in cooperation with the position of the jaws of stationary jaw mechanism 168 determines the pressure to be applied against the flange segment and, thus, the amount of stretching or shrinking needed to provide the desired, preprogrammed panel curvature. The interrelationships of both lasers with the computer at both flanges 156 and 156*a* are independent of each other.

Briefly, the steps undertaken are as follows:

(1) the jaw mechanisms are drawn back in two steps by first moving the movable jaw mechanism and then the head to distance both jaw mechanisms from engagement with the panel segment which had been subjected to a prior stretching or shrinking, (2) the panel is indexed to advance the stretched/shrunk flange segment from the jaws and to position a fresh flange segment in position for stretching or shrinking, (3) the head is moved back to place the fixed jaw in contact with the fresh flange segment, (4) laser radiation detects the panel perforated face, and (5) laser radiation information is fed into the computer which directs the movable jaw mechanism first to move into contact the adjacent surface of the flange segment and second to apply the precise amount of pressure to provide a precise stretching or shrinking to the flange segment.

Because the interrelationships of both lasers with the computer at both flanges 156 and 156*a* are independent of each other, the amount of stretching or shrinking of each flange is tailored to that flange and the curvature of the panel adjacent thereto. Such independence provides for a fine-tuning of the curving operation, and the consequent improved quality of the thus-produced curve and of the finished panels. While inspection is still needed, much less inspection is required.

Figure 23:
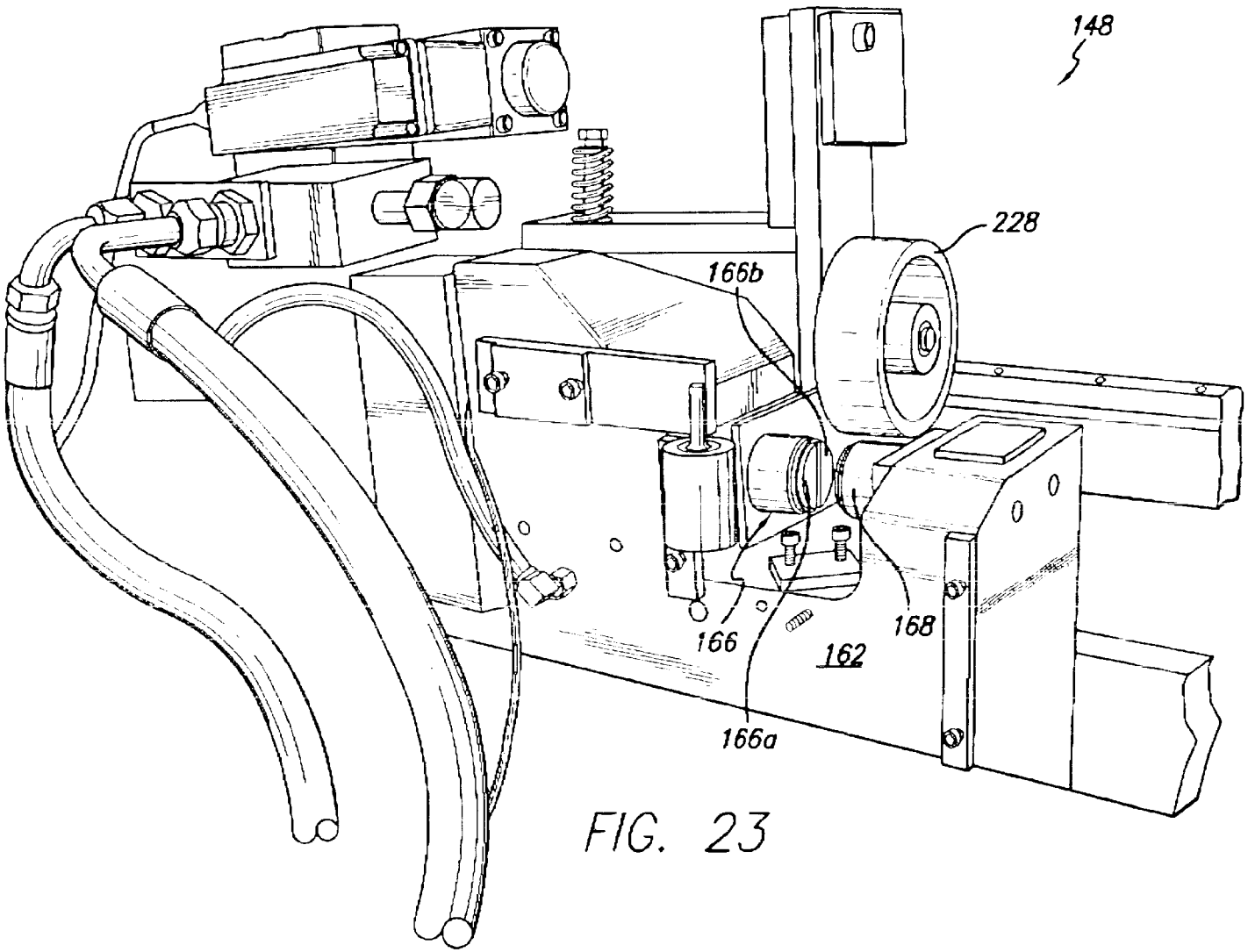
FIG. 23 is a view of a portion of the machine illustrated in FIG. 22 detailing one of the two jaw mechanisms and its support head.
Figure 24:
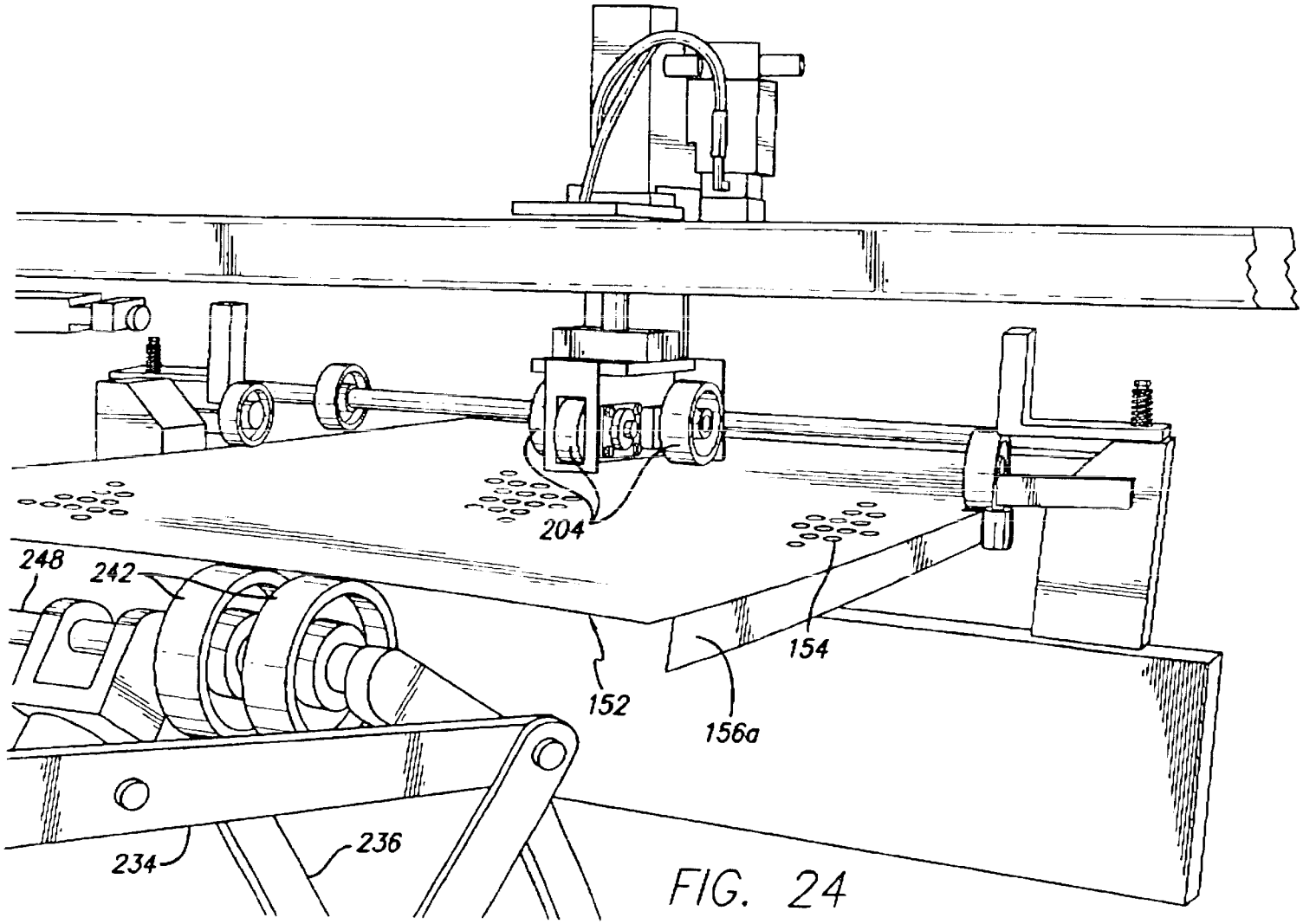
FIG. 24 is another view of a portion of the machine illustrated in FIG. 22 detailing the back-side section of the improved panel curving machine and a portion of the scissors apparatus.
Figure 25B:
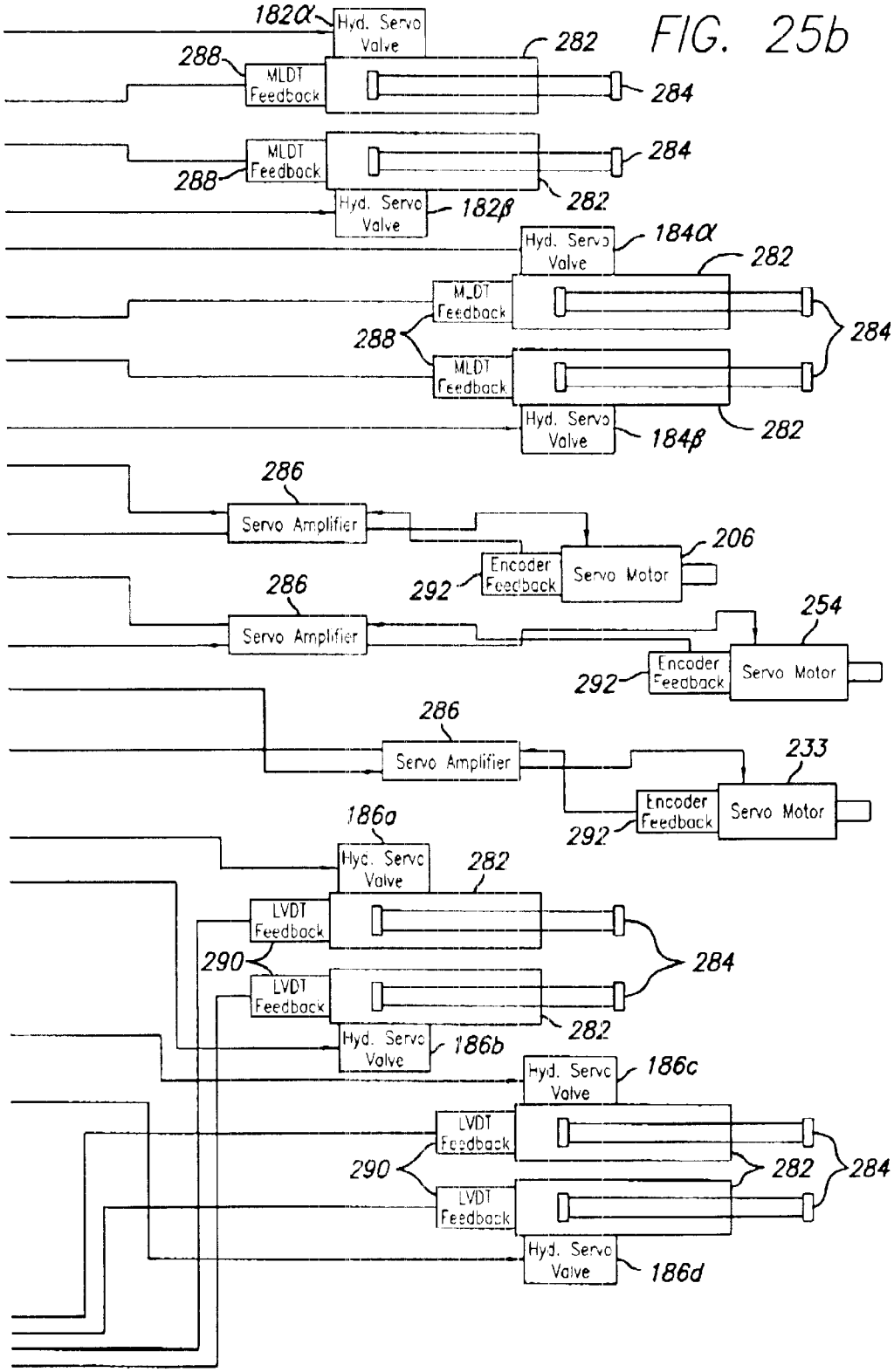

Reference is now directed to FIGS. 21(*a*) and 21(*b*) which illustrate scissors apparatus 176 placed by machine 148, at its back-side section 222, in position to receive and support the curved panel as it exits therefrom. As shown also in FIG. 22, the panel, before it is curved, enters the machine at front-side section 224, and rides on vertically-disposed supporting rollers 226, and between horizontally disposed rollers 227. Rollers 228 (see also FIG. 23) at back-side section 222 are positioned on the respective heads adjacent the jaws mechanisms for guiding the panel through the stretching/shrinking jaws. The scissors apparatus is carried on a trolley 230, which is disposed to move towards and away from machine 148 on tracks 232 by means of a suitable coupling to a servo motor 233.

Scissors apparatus 176 includes a linkage 234 comprising a plurality of bars 236 joined together at pivots 238. The linkage is pivotally mounted on trolley 230 at its base 240 to permit it to be turned 180° and its also so joined to the trolley as to permit it to be raised and lowered into positions 176(*a*) and 176(*b*). Hydraulic cylinders are appropriately connected to the linkage and its components bars and to proportional directional control valve 186 for control by computer 150. The linkage is further provided with three sets 242, 244 and 246 of four rollers 248 journalled on axles 250.

Both the pivoting of the linkage to adjust the heights and positions of rollers 248 and the 180° turning of the linkage permits the three sets of rollers to be adjusted respectively to the curvature and the concave or convex curve of the panel exiting from the machine. In a first 180° position, e.g., for a concavely curved panel, the front roller set of the scissors assembly is placed higher than its rear set of rollers. In the second 180° position, e.g., for a convexly curved panel, the front roller set of the scissors assembly is placed lower than its rear set of rollers. The respective heights among the three sets of rollers are adjusted to conform them with the particular curvatures of the respective concave and convex surfaces. The 180° is manually performed, while the extensions of the roller sets and their heights are set by the computer along with the initial setting of the machine.

Figure 21A:
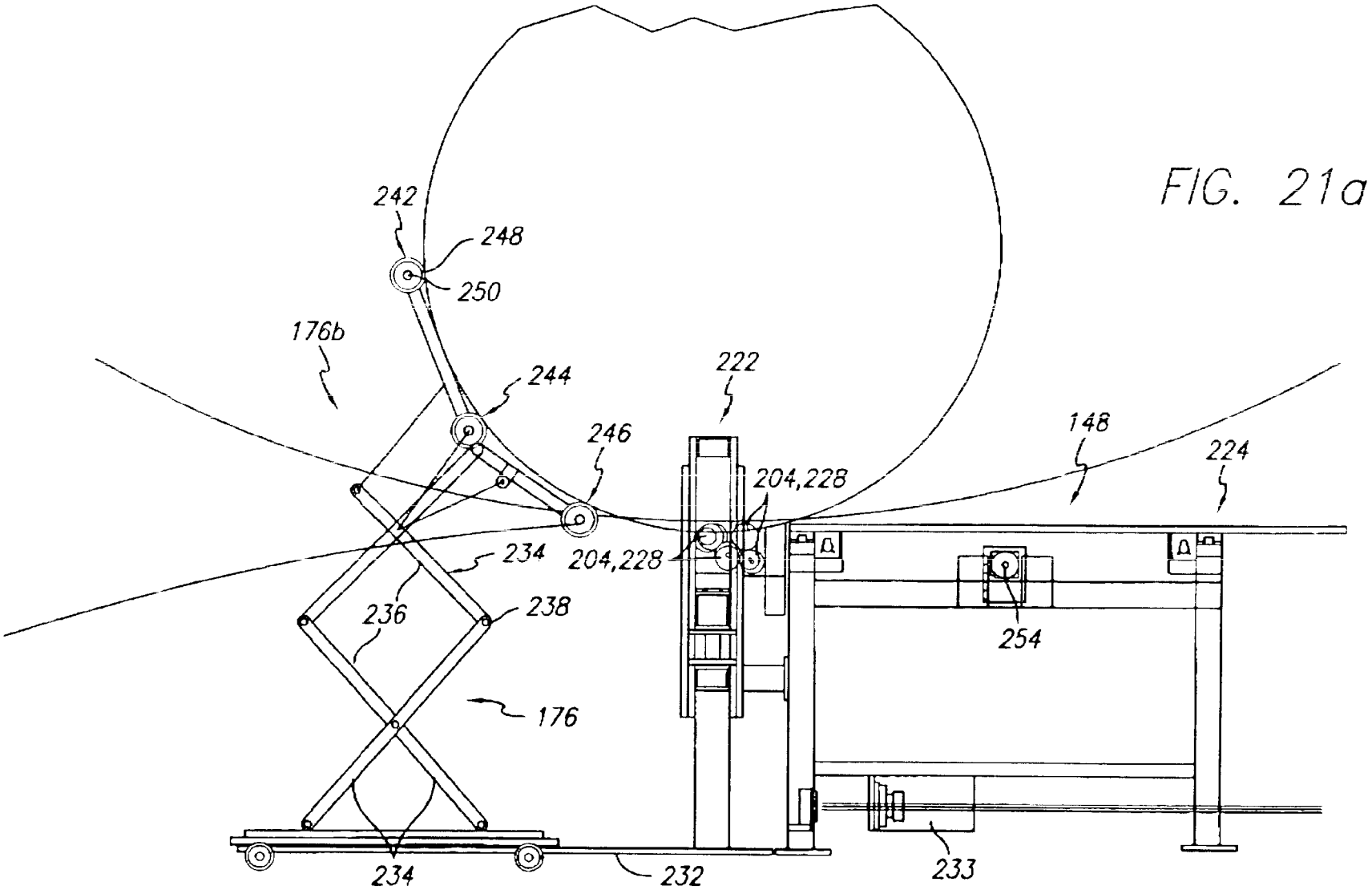
FIGS. 21(*a*) and 21(*b*) show the scissors mechanism positioned in front of the back-side of the curving machine for use in supporting the curved panel as it exits therefrom.
Figure 21B:
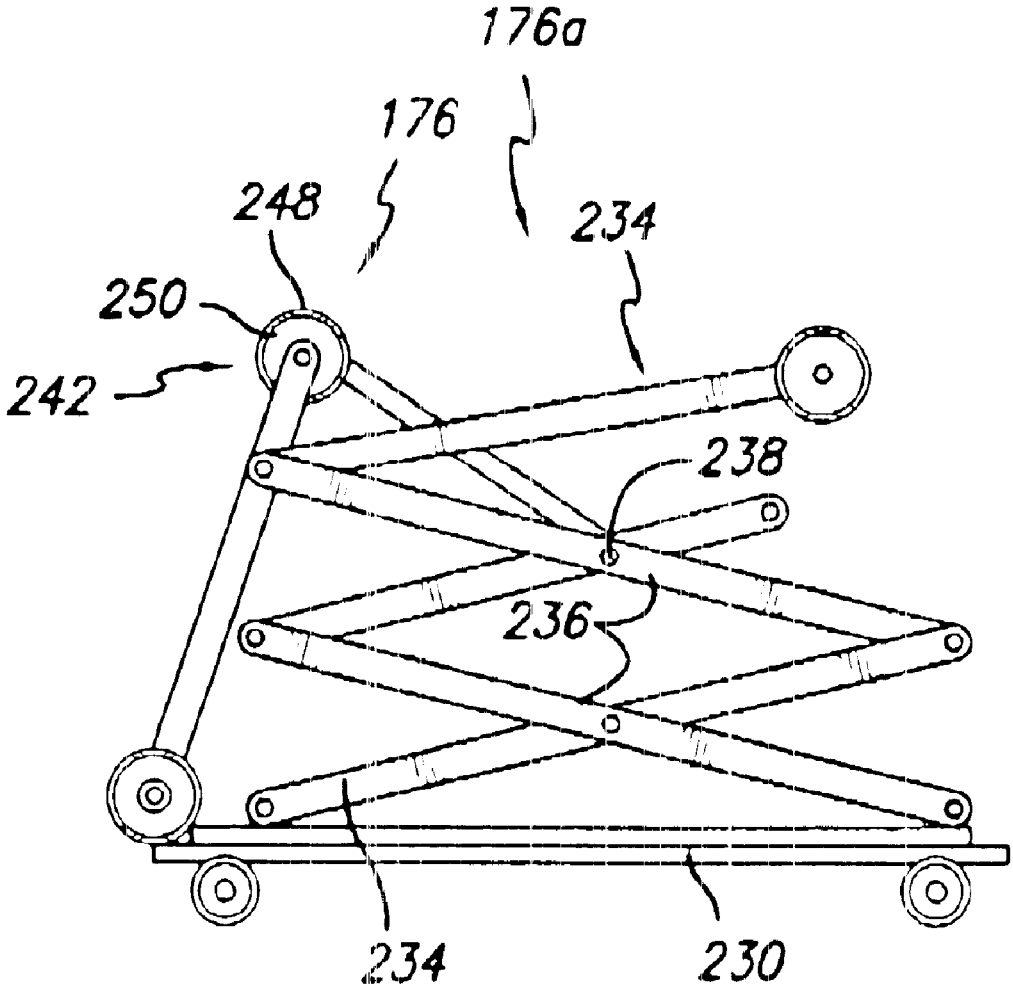

As best shown in FIG. 22, both vertically disposed rollers 226 and horizontally disposed rollers 227 are carried on a pair of frame members 250 which are movable towards and away from one another in the direction of double-headed arrow lines 252. Movement frame members 250 is effected by a motor 254, as shown in FIG. 21*a*, which is suitably coupled thereto by appropriate axles and worm and pinion gearing.

Reference is now made to the electrical connection diagram and the input/output connection diagram illustrated in FIGS. 25*a*, 25*b*, 26*a* and 26*b*, respectively designated by indicia 260 and 262. The connections amongst the various components are depicted by single-headed and double-headed arrow lines, each of which typically represents a plurality of electrical leads, conventionally arranged within a flat cable, a multi-conductor cable, or a single conductor cable/wire. The single-headed lines denote uni-directional flow of data and/or signals. The double-headed lines denote bi-directional flow of data and/or signals.

At the center of the system is an 8-channel motion control computer 264 to which a 4-channel expansion board 266 is connected. Both are supported on a conventional PC computer chassis 268, all as circumscribed by computer 150 shown in FIGS. 14 and 18.

Computer 264, which provides all motion control processing for machine 148, is coupled directly through a plurality (here, four in number for its eight channels) of 2-channel analog interface boards 270, 272, 274 and 276, or indirectly through expansion board 266 through a plurality (here, two in number for its four channels) of 2-channel analog interface boards 278 and 280. While each of the interface boards is illustrated as a 2-channel analog interface board, it is not required that this specific 2-channel form of board be employed; any similarly functioning component may be used in its place. Its function is simply to provide the appropriate interconnect format, both electronically and mechanically, between motion control computer 264 and the intended driver or drive mechanism. In the present invention, the intended drive mechanisms comprise hydraulic servo valves (generically identified by indicia 182, 184 and 186, see FIG. 14) or servo motors 206, 233 and 254 (see FIGS. 18 and 21*b*, respectively). Each hydraulic servo valve is coupled to the intended drive mechanism, which comprises a hydraulic cylinder 282 for driving a piston 284. Each servo motor 286 is connected to its analog interface board by a servo amplifier 286.

Feedback to the computer from the several driving mechanisms provides a check on the proper orientations thereof. Feedback from hydraulic servo valves 182 and 184 is provided by magnetostrictive linear displacement transducer (MLDT) feedback circuitry 288. Feedback to computer 264 from the several hydraulic servo valves 186 is provided by linear voltage displacement transducer (LVDT) feedback circuitry 290, through an analog feedback terminal board 291. Feedback to the computer from servo motors 206, 233 and 254 is provided by encoder feedback circuitry 292 through their respective servo amplifiers 286 to their respective 2-channel analog interface boards. The feedback sensor type may be replaced by any standard type of position feedback device available with suitable interface format and is not restricted to the specific types discussed in this application.

More specifically, first 2-channel analog interface board 270 is connected through its "Channel 1—Head Position Left" and its "Channel 1—Head Position Right" channels respectively to proportional directional control valves 182α and 182β, respectively for driving jaw heads 162α and 162β.

Second 2-channel analog interface board 272 is connected through its "Channel 3—Work Jaw Left" and its "Channel 4—Work Jaw Right" channels respectively to proportional directional control valves 184α and 184β, respectively for driving the two sets of jaw halves 166*a*, 166*b*, 168*a* and 168*b*. Alternatively stated, four jaw halves on the "left-hand" side are driven by control valve 184α and four jaw halves on the "right-hand" side are driven by control valve 184β.

Third 2-channel analog interface board 274 is connected through its "Channel 5—Sheet Index" and its "Channel 6—Sheet Width" channels respectively to servo motors 206 and 254. Servo motor 206 is employed to index or discretely move the panel being curved forwardly through machine 148. Servo motor 254 is employed to place horizontally disposed rollers 227 (see FIG. 22) flush against flanges 156, in accordance with the specified width of the specific panel being processed.

Fourth 2-channel analog interface board 276 is connected through its "Channel 7—Scissor Position" and its "Channel 8—Scissor Lift Cylinder" channels respectively to servo motor 233 and hydraulic servo valve 286*a*. Servo motor 233 is used to move trolley 230 and scissors apparatus 176 into its proper placement with respect to machine 148. Hydraulic servo valve 286*a* is employed to operate appropriate ones of linkage 234 and bars 236 to extend or lift the scissors apparatus from its trolley 230 and to retract or fold the scissors apparatus back onto the trolley.

Fifth 2-channel analog interface board 278 is connected through its "Channel 9—Scissor Cylinder A" and its "Channel 10—Scissor Cylinder B" channels respectively to effect two positionings of others of linkage 234 and bars 236 (other than those effected by interface board 276) to locate two of rollers set 242, 244 and 246 in accordance with the curvature imparted to the processed panel.

Sixth 2-channel analog interface board 280 is connected through its "Channel 11—Scissor Cylinder C" and its "Channel 12—Hydraulic Pressure/Feedwheel" channels respectively to effect a third positioning roller set and to provide couplings to hydraulic pressure valve 193 and with a feed encoder 294. The third positioning roller set of the remaining linkage 234 and bars 236 (other than those operated on by interface boards 276 and 278) locates the third of rollers set 242, 244 and 246 in accordance with the curvature imparted to the processed panel. Feed encoder 294 performs the function of detecting the position of the panel, to determine if there is slippage thereof, and to effect any needed correction.

Further included in the electrical connections, as shown in diagram 260 (see also FIG. 14), are left and right jaw sensors 166α and 166β and left and right laser position sensors 296α and 296β, which are associated with laser devices 210 (210α and 210β—see also FIG. 16). Laser position sensors 296α and 296β provide the information which is compared with the desired curvature information stored in computer 150, as stated previously with respect to FIGS. 14 and 16, by which lasers 210α and 210β monitor the curvature of panel 152, specifically of its perforated face 154 adjacent its opposed flanges 156 and 156*a*, on both the left-hand side (α) and the right-hand side (β) of machine 148.

All of hydraulic system pressure sensor 189, left-hand reciprocable jaw mechanism 166α, right-hand reciprocable jaw mechanism 166β, left laser position sensor 296α, right laser position sensor 296β and hydraulic system temperature sensor 191 are connected to analog feedback terminal board 291 and, thus, to computer 264.

Information from computer 274 is displayed on a monitor 298, and data input to the computer is effected by a keyboard 300 and a mouse 302.

Figure 26A:
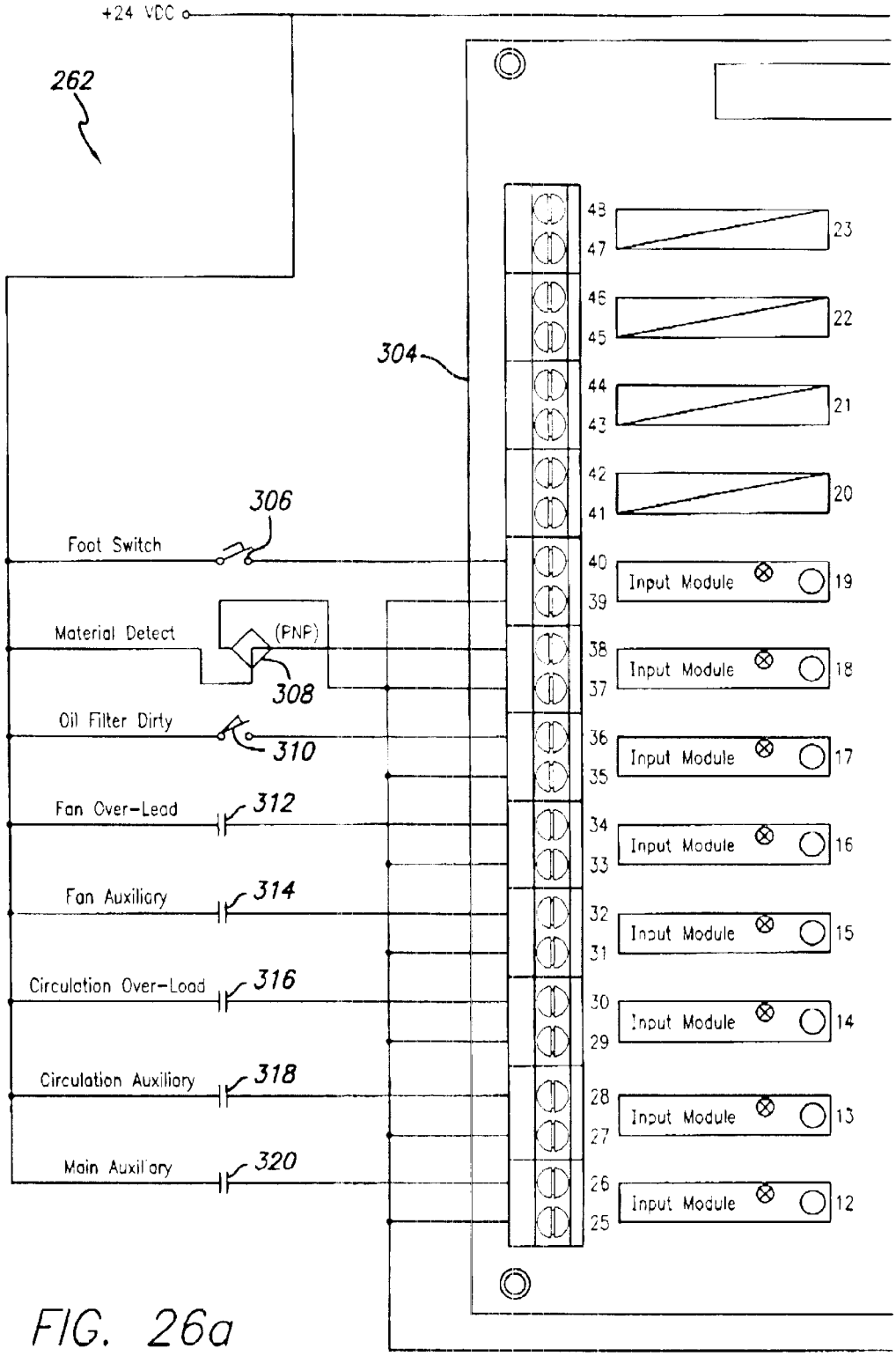
FIGS. 26*a* and 26*b* depict respective halves of an input/output connection diagram which includes one component shown in FIG. 25*a*.
Figure 26B:
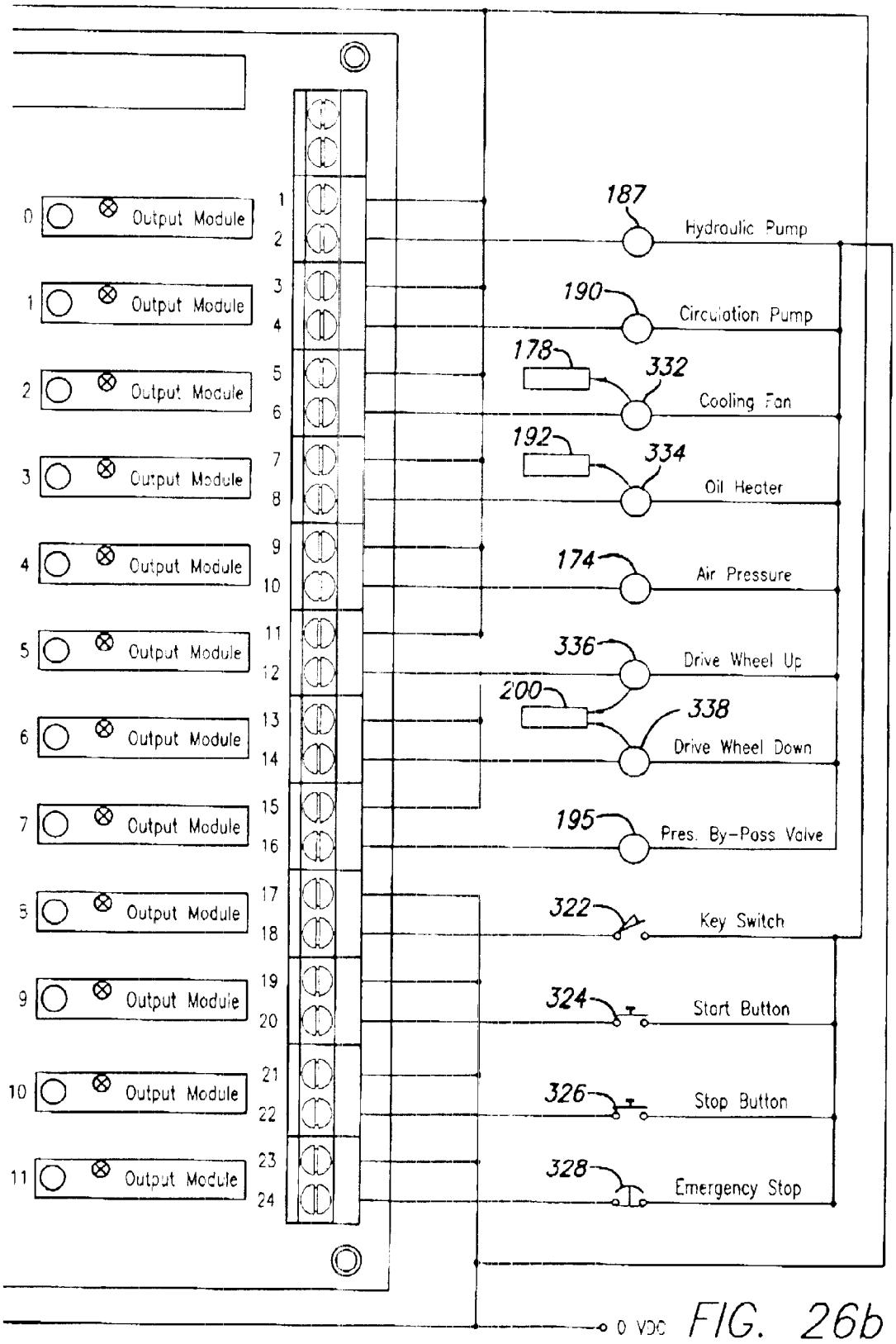

Input and output coupling to other external devices is enabled by a 24-channel input/output board 304, which is more fully illustrated in FIGS. 26*a* and 26*b*. The input devices include a foot switch 306, a material detect sensor 308, an oil filter dirty switch 310, and miscellaneous components 312, 314, 316, 318, 320, 322, 324, 328 and 330. The output devices include hydraulic pump 187, circulation pump 190, a cooling fan 332 coupled to 178, an oil heater 334 coupled to temperature control 192, air pressure pneumatic supply 174, and circuitry 336 and 338 to move drive wheels 200 up and down.

Further information concerning the machine is as follows:

MACHINE COMPOSITION

Section 1 Axes Definition

There are eleven closed loop axes on the machine. Three of these axes are driven by an electric servo drive with incremental encoder feedback. (A quad B with marker). The other 8 axes are hydraulically controlled with Temposonics® feedback mounted in the cylinders. Four Temposonics® (e.g., U.S. Pat. No. 5,545,984) MLDT type and four are LVDT type. Six of the axes are considered set-up or material support axes, that is, they position, prior to the main cycle starting, and maintain that position as the machine runs. The other five axes are considered "work" axes and are constantly in use during the cycle. The machine axes are as follows:

1. Jaw position left. This hydraulic cylinder carries the work jaws into position for a given sheet width. The sheet width is a program variable; therefore, prior to running a cycle, the jaw positioners (left and right) move the work jaws to the correct width setting. Once the cycle is running, the jaw positioners oscillate around the position set by the selected sheet width. This oscillation is a program variable defined for the part to be run, and is in the range of ±0 to 0.050", for a maximum oscillation cycle of 0.2" (i.e., 0.05" in, 0.1" out and 0.05" back to position). The frequency of this oscillation will be a program variable, set from 0 to 3 Hertz.

2. Jaw Position right. This hydraulic cylinder will be slaved to 1. These two master/slave axes mirror each other, i.e. a theoretical width command of zero would place both work jaws on the machine centerline. A theoretical width command of 20" will place both work jaws 10" off center.
3. Jaw Work System left. This hydraulic cylinder opens and closes the two piece pinch die, one side being in a fixed position. The sheet material runs through this die. The program variables of die stroke, velocity and pressure will dictate how much the material is stretched on each stroke, thus controlling the overall curvature of the panel after forming. This cylinder will stroke every time the sheet indexer comes to rest during a cycle. The sheet cannot be indexed until the jaw work system has finished its stroke. Although the jaw work system cylinder has a 1" stroke, it should be preset based upon the program variable for sheet thickness to provide minimal clearance for the sheet to feed through, thus optimizing the stroke cycle to a minimum. During a part run, the stroke cylinder variables and the variable for sheet feed distance can be modified based upon sensing the curvature of the panel based upon the 2 sheet laser sensors. Refer to the section on Adaptive Control for a detailed description.
4. Jaw Work System right. This hydraulic cylinder work in mirror image to that described in paragraph 3 above. These two axes cannot be tied together as a master slave because individual modification of program variables are required, based upon the measurement derived from the two output lasers.
5. Sheet Indexer. This electric servo will drive a 4.95" friction wheel for the purpose of feeding the material through the machine. The feed distance will be a program variable but, as in axes 3 and 4 can be modified during a part run in order to control the curvature of the output sheet based upon the measured value at the laser sensors. Programmable range of this parameter is 0.375" to 4" per index at a programmable speed of 0.1 to 3 inches per second.
6. Sheet width. This electric servo will drive a ball screw assembly connected to a support mechanism on the input side of the machine. This will support the sheet material as it is fed through the system. The program variable of the sheet width will drive this assembly to the proper position prior to starting the cycle.
7. Scissor position. This electric servo will drive the base support for the scissor mechanism to be used for material support on the output side of the machine. The program variable of position for a given part number is defined during the setup of a part being run for the first time.
8. Scissor lift. This hydraulic cylinder will provide the vertical positioning component of the scissor lift assembly. The program variable of position for a given part number will be defined during the setup of a part being run for the first time.

9. Scissor A cylinder. This hydraulic cylinder is secured to one of three individual arms which support the material on the output side of the machine. The program variable of position for a given part number is defined during the setup of a part being run for the first time.
10. Scissor B cylinder. This hydraulic cylinder is secured to one of three individual arms which support the material on the output side of the machine. The program variable of position for a given part number is defined during the setup of a part being run for the first time, by jogging each cylinder as the part runs. Once a satisfactory position has been reached, this position can then be stored.
11. Scissor C cylinder. This hydraulic cylinder is secured to one of three individual arms which support the material on the output side of the machine. The program variable of position for a given part number is defined during the setup of a part being run for the first time.

Section 2 Power Up and Initialization

1. Once the main disconnect has been turned on, the machine control system (PC) can be started.
2. After the machine control system has initialized, the operator is prompted to start the hydraulic pump.
3. Hydraulic system temperature is displayed while the oil is coming up to temperature. The oil heating system is controlled externally from the machine control system, but the system will not allow operation until proper temperature is reached.
4. As the hydraulic system is coming up to temperature, the operator is prompted to home the three electric axes which require homing, i.e., sheet indexer, sheet width, and scissor assembly positioner.
5. The system is now ready for operation.

Section 3 Mode Selection

1. Manual Mode—This mode of operation allows the operator to manually select and jog any of the machine axes. The manual jog screen allows for the following functions:
   Axis select
   % Feed rate select
   Jog plus
   Jog minus
2. Single cycle mode—This mode of operation allows the operator to manually enter the cycle parameters. Each time the START button is pressed, the machine moves through one sequence, feed sheet and then pinch. These values are then be stored as a part of the program.
3. Auto run mode—This mode allows the operator to activate a stored program defined by part number and to initiate the auto cycle once a panel has been loaded on the machine. The automatic cycle is as follows.

The operator elects the program for the part to be run.

1. If this is a new part, pressing the cycle start will cause the "set-up" axes to position per program value. If this is a start run, the operator will load a panel and, then by pressing cycle start, the auto operation will be initiated.
2. If this is a new part, the operator loads the panel after the set-up axes have positioned. By pressing the cycle start the second time, the auto operation is initiated. The sheet indexer (5) the feeds the panel into the machine. During this motion, the jaw position left and right (1 & 2) is oscillated to allow smooth material feed.
3. Upon detection of the panel at the work point by a machine sensor, the sheet indexer (5) continues to feed the programmed amount.
4. When the sheet indexer (5) is in position, the jaw position left and right (1 & 2) should be in position at the programmed width (null).
5. Once the sheet index (5) and jaw position left and right (1 & 2) are in position, the jaw work left and right (3 & 4) executes the programmed stroke.
6. Once the programmed stroke has been executed and the jaw work left and right (3&4) is in position, the sheet will index as described in paragraph (d) above.
7. Consecutive jaw work left and right (3 & 4) strokes may be modified, based upon the measured panel curvature derived from the laser feedback. This step maintains the programmed value for finished sheet curvature.
8. This sequence continues until the end of the sheet is detected.

Section 4 Program Variables.

| | Minimum Value | Maximum Value |
|---|---|---|
| Nominal sheet radius | 20" | 3600" |
| Tolerance | 0.05" | 0.5" |
| Sheet width | 12" | 60" |
| Sheet thickness | 0.02" | 0.25" |
| Initial sheet feed | 0" | 50" |
| Sheet feed | 0.375" | 4" |
| Feed speed | 0.1 | 3 I.P.S. |
| Work jaw clearance | 0.05" | 0.5" |
| Work jaw stroke | 0.01" | 0.1" |
| Work jaw stroke speed | 0.1 I.P.S. | 1.0 I.P.S. |
| Work jaw pressure | 20 P.S.I. | 2,000 P.S.I. |
| Jaw position oscillation | 0 | 0.05" |
| Jaw position oscillation speed | 0 | 3 Hz |

Section 5 Adaptive Control

The control system is equipped with an adaptive control feature. This feature allows the control to modify program parameters, as needed or desired, based upon the feedback from the two laser sheet sensors. This feedback is equated with a panel radius, i.e. xx VDC=yy inches radius. As the part is run, this feedback is checked with the programmed nominal radius. Any one of two cycle variables can then be modified to maintain the finished panel within proper dimension±tolerance. These variables are:

1. Work jaw pressure (left and right), (higher pressure= tighter radius and vice-versa)
2. Sheet feed (shorter feed means more pinch cycles= tighter radius and vice-versa)

The machine employs adaptive cycle control as follows:

1. When a work jaw stroke cycle is called, the control commands the two work jaw axes to the programmed stroke dimension. The work jaw cylinder pressure is constantly monitored. When this pressure reaches the set value for work jaw pressure, the stroke is terminated as if the programmed position were reached.
2. During the cycle, if the curvature of the output panel is such that the bend needs to be increased, the pressure set point will be increased in increments based upon a limited access system parameter until the panel is within tolerance.
3. Conversely, if the curvature of the output panel is such that the bend needs to be decreased, the pressure set point will be decreased in increments based upon a limited access system parameter until the panel is within tolerance.
4. During the above parameter modifications, if either the upper (2,000 P.S.I.) or lower (20 P.S.I.) limits are reached, the parameter for sheet feed will be modified in steps based upon a limited access system parameter to achieve the correct curvature.

5. Should the limits of pressure and sheet feed be reached without the panel being within tolerance, accommodation can be made in the control system to use the work jaw stroke speed as a last resort for panel curvature modification.

COMPUTER FLOW CHART

1. Turn on main power
   a. Start computer
2. Start startup program
   a. Main pump will start.
   b. The computer will start oil circulation pump and check oil temperature.
   c. If low it will start heaters to heat oil to preset temperature.
   d. If too high, it will start the cooler and lower the temperature to the preset temperature. Once the oil is at proper temperature, the computer allows the startup program to continue.
   e. The computer will lower the scissors, if needed.
   f. The computer will zero all servomotors to ready position.
   g. The computer will start the main pump motor.
   h. The computer will check the oil pressure to be sure that the bypass is working properly and at preprogrammed pressure.
   i. The computer will run the jaw position cylinders through their full cycle to circulate the oil.
   j. The computer will run the jaw cylinders through their full cycle to circulate the oil.
3. Operator must scan previous programs or write a new program
   a. The computer will set at pressure as shown in program.
   b. The computer will set jaw position at the width as shown in the program.
   c. The computer will set jaw cylinder distance as shown dimension in the program.
   d. Panel width servo will set at width as shown in the program.
   e. Feed will be set as shown in the program.
   f. Speed will be set as shown in the program.
   g. If known, the computer will set the laser for curve distance.
   h. If known, the computer will set the scissors lift distance.
   i. If known, the computer will set the scissors lift support arms.
4. Machine is now ready to start curving program
   a. The electric eye will see panel and tell the computer that it can now start the curving program.
5. Pushing start button will now start the curving program
   a. Drive system will now close on panel.
   b. Jaw position cylinder will move jaws into crimping position.
   c. Jaws will now close to set pressure.
   d. After crimping, the jaw position cylinder advances the jaw cylinder to the amount set in the program to clear the panel.
6. Servomotor will advance the panel to the set dimension
   a. Distance wheel checks to make sure that the panel has moved the correct amount.
   b. If the panel hasn't moved to the set distance, the error light will light and stop further action.
   c. If all checks out, the cycle will continue as described in paragraphs 5B–6C.
7. When the panel reaches the laser, it reads the curve as set in program
   a. Then adjust the jaw distance as necessary to keep the panel within program parameters.
   b. If necessary, the computer will raise the hydraulic pressure to reach the new set dimension.
   c. If no laser setting is in the program, it can be set now, or later as needed.
8. The program continues to the point where the scissors lift is needed for support.
   a. If already in the program and no adjustment is necessary, the program continues.
   b. If adjustment is needed, the operator jogs the lift or any of the three arms into the necessary position.
   c. If not in the program, the scissors lift must now be adjusted.
   d. Jog the scissors to the approximate position.
   e. Raise the lift to the approximate position.
   f. Adjust the arms to the approximate position.
   g. As the panel runs, the operator fine tunes, as needed, the lift by adjusting all items as described in paragraphs 9a.-9c.
9. When the electric eye no longer sees the panel, the cycle will continue the preset number of crimps and stop.
10. When the remote switch is activated by the operator, the drive system opens and the panel is removed from the machine.

Although the invention has been described with respect to particular embodiments thereof, it should be realized that various changes and modifications may be made therein without departing from the spirit and scope of the invention.

What is claimed is:

1. A method for curving a panel having a center portion and flanges angularly depending therefrom, comprising the steps of:

simultaneously and substantially equally applying lengthwise dimensional changes in opposed side portions of the flanges to impart a curvature to the panel adjacent the dimensionally changed opposed side portions either (a) by stretching the panel opposed side portions to impart a concave curvature to the or (b) by shrinking the opposed side portions to impart a convex curvature to the panel;

appropriately repeating said stretching and shrinking steps to successive opposed side portions of the flanges;

sensing the panel during said applying steps to obtain information of the curvature;

comparing the curvature information thus obtained with a pre-established specification; and adjusting said applying and repeating steps to conform the curvature to the specification.

2. A method for curving a panel having a center portion and flanges angularly depending therefrom, comprising the steps of:

simultaneously and substantially equally applying lengthwise dimensional changes in opposed side portions of the flanges to impart a curvature to the panel adjacent the dimensionally changed opposed side portions by utilizing, for each flange, paired opposing jaws, each including jaw halves disposed to move towards and away from one another;

positioning each of the paired opposing jaws on either side of its flange at a segment thereof for enabling the flange segment sandwiched therebetween to be gripped by the jaw halves, and moving the jaw halves towards one another to shrink the flange segment and to effect a convex shape to the curvature, and away from one another to stretch the flange segment and to effect a concave shape to the curvature;

repeating said applying step to successive opposed side portions of the flanges;

sensing the panel during said applying steps to obtain information of the curvature;

comparing the curvature information thus obtained with a pre-established specification; and adjusting said applying and repeating steps to conform the curvature to the specification.

3. A method according to claim 2 further comprising the steps of housing each of the opposing jaws in a head, one for each on the flanges, and moving the heads towards and away from one another to accommodate different widths of the panel.

4. A method for curving a panel having a center portion and flanges angularly depending therefrom, and a lengthwise axis parallel to the flanges and a crosswise axis positioned normal to the lengthwise axis, comprising the steps of:

simultaneously and substantially equally applying lengthwise dimensional changes in opposed side portions of the flanges to impart a curvature to the panel adjacent the dimensionally changed opposed side portions by (1) utilizing a pair of opposing jaws, each including jaw halves disposed to move towards and away from one another along the lengthwise axis; and (2) supporting the jaw pair in a head such that (a) the jaw pair, as an entity, is capable of movement parallel to the crosswise axis when the head is likewise so moved, (b) one of the jaws is fixed with respect to the head and c) the other of the jaws is movable with respect to the head along the crosswise axis and, thus, movable towards and away from the fixed one of the jaws; and repeating said applying step to successive opposed side portions of the flanges, in which in each said applying step, for each flange as representative of the other flange, and commencing when both the fixed one and the movable other of the jaws are gripping the flange, (1) retracting the movable other of the jaws from gripping the flange segment in a first direction;

(2) retracting the head from the flange segment in a second direction which is opposite from the first direction, and for a distance that permits both the fixed one and movable other of the jaws to be out of contact with the flange;

(3) indexing the panel along the lengthwise axis to position a new segment of the flange between the fixed one and movable other of the jaws;

(4) moving the head in the first direction to place the fixed one of the jaws into contact with the new flange segment;

(5) moving the movable other of the jaws in the second direction to place it in contact with the new flange segment and, with the fixed one of the jaws, to securely grip the new flange segment between the fixed one and movable other of the jaws; and (6) moving the jaw halves towards one another to shrink the flange segment and to effect a convex shape to the curvature, and away from one another to stretch the flange segment and to effect a concave shape to the curvature.

5. A method for curving a panel having a center portion and flanges angularly depending therefrom, comprising the steps of:

simultaneously and substantially equally applying lengthwise dimensional changes in opposed side portions of the flanges to impart a curvature to the panel adjacent the dimensionally changed opposed side portions either (a) by stretching the opposed side portions to impart a concave curvature to the panel or (b) by shrinking the opposed side portions to impart a convex curvature to the panel;

appropriately repeating said stretching and shrinking steps to successive opposed side portions of the flanges;

sensing the panel during said applying steps to obtain information of the curvature;

comparing the curvature information thus obtained with a pre-established specification; and adjusting said applying and repeating steps to conform the curvature to the specification.

6. A method according to claim 5 in which said sensing step comprises the step of exposing the panel with laser radiation.

7. A method according to claim 5 further comprising the steps of supporting the fully curved panel after said applying and repeating steps at a plurality of spaced locations on the panel for minimizing variations in the curvature for deformation.

8. A method for curving a panel having a center portion and flanges angularly depending therefrom, comprising the steps of:

simultaneously and substantially equally applying lengthwise dimensional changes in opposed side portions of the flanges to impart a curvature to the panel adjacent the dimensionally changed opposed side portions;

repeating said applying step to successive opposed side portions of the flanges;

sensing the panel during said applying steps to obtain information of the curvature;

comparing the curvature information thus obtained with a pre-established specification;

adjusting said applying and repeating steps to conform the curvature to the specification; and supporting the fully curved panel after said applying and repeating steps at a plurality of spaced locations on the panel for minimizing variations in the curvature for deformation by utilizing supports and coupling the supports with the comparing apparatus for effecting a configuration of the supports that mirrors the curvature for fully supporting all parts of the panel.

9. Apparatus for curving a panel having a center portion and flanges angularly depending therefrom, comprising:

grippers for gripping opposed side portions of each of the flanges;

dimensionally changing mechanisms coupled to said grippers for simultaneously and substantially equally applying lengthwise dimensional changes in the opposed side portions of the flanges to impart a curvature to the panel adjacent the dimensionally changed opposed side portions, said dimensionally changing mechanisms alternately operable (a) to stretch the opposed side portions to impart a concave curvature to the panel and (b) to shrink the opposed side portions to impart a convex curvature to the panel; and an indexing mechanism for indexing the flanges in incremental steps for enabling said grippers and said dimensionally changing mechanisms to apply, in seriatim, the lengthwise dimensional changes in successive segments of the opposed side portions of the flanges.

10. Apparatus according to claim 9 further including sensors adjacent said grippers for sensing the panel to obtain information of the curvature, comparing apparatus for comparing the curvature information thus obtained with a pre-established specification, and adjusting mechanisms for adjusting said grippers to conform the curvature to the specification.

11. Apparatus according to claim 10 further including lasers coupled to said sensors for providing radiation directed to the panel for providing the information.

12. Apparatus for curving a panel having a center portion and flanges angularly depending therefrom, comprising:

grippers for gripping opposed side portions of each of the flanges, each of said grippers including a pair of opposing jaws, and each said jaw each includes jaw halves disposed to move towards and away from one another along an axis which is parallel to the flanges;

dimensionally changing mechanisms coupled to said grippers for simultaneously and substantially equally applying lengthwise dimensional changes in the opposed side portions of the flanges to impart a curvature to the panel adjacent the dimensionally changed opposed side portion;

an indexing mechanism for indexing the flanges in incremental steps for enabling said grippers and said dimensionally changing mechanisms to apply, in seriatim, the lengthwise dimensional changes in successive segments of the opposed side portions of the flanges;

sensors adjacent said grippers for sensing the panel to obtain information of the curvature;

comparing apparatus for comparing the curvature information thus obtained with a pre-established specification;

adjusting mechanisms for adjusting said grippers to conform the curvature to the specification; and a head, for each of said grippers, supporting said respective jaw pair and including apparatus that (a) enables said jaw pair, as an entity, to move parallel to an axis which is normal to the lengthwise axis, when said head is likewise so moved, (b) fixes one of said jaws with respect to said head and c) enables the other of said jaws to move with respect to said head along the crosswise axis and, thus, to move said movable other of said jaws towards and away from said fixed one of the jaws.

13. Apparatus according to claim 12 in which said head apparatus is operable to retract the movable other of the jaws from gripping the flange segment in a first direction;

retraction apparatus for retracting the head from the flange segment in a second direction which is opposite from the first direction, and for a distance that permits both the fixed one and movable other of the jaws to be out of contact with the flange;

indexing apparatus for indexing the panel along the lengthwise axis to position a new segment of the flange between the fixed one and movable other of the jaws;

head moving apparatus (a) for moving the head in the first direction to place the fixed one of the jaws into contact with the new flange segment, (b) for moving the movable other of the jaws in the second direction to place it in contact with the new flange segment and, with the fixed one of the jaws, to securely grip the new flange segment between the fixed one and movable other of the jaws, and for moving the jaw halves towards one another to shrink the flange segment and to effect a convex shape to the curvature, and away from one another to stretch the flange segment and to effect a concave shape to the curvature.

14. Apparatus according to claim 13 further including scissors apparatus for supporting the panel as it exits with the curvature from said grippers.

15. Apparatus according to claim 14 in which said scissors apparatus includes linkages and bars, a plurality of sets of rollers spaced apart from one another and articulation mechanisms coupled to said linkages and bars for providing said rollers with a configuration that mirrors the curvature for supporting parts of the panel.

16. Apparatus according to claim 15 further including interconnections between said scissors apparatus and said comparing apparatus for effecting the roller configuration.

17. Apparatus for curving a panel having a center portion and flanges angularly depending therefrom, comprising:

grippers for gripping opposed side portions of each of the flanges, each of said grippers including a pair of opposing jaws, and each said jaw each includes jaw halves disposed to move towards and away from one another along an axis which is parallel to the flanges;

dimensionally changing mechanisms coupled to said grippers for simultaneously and substantially equally applying lengthwise dimensional changes in the opposed side portions of the flanges to impart a curvature to the panel adjacent the dimensionally changed opposed side portion; and a head supporting said jaw pair and including apparatus that (a) enables said jaw pair, as an entity, to move parallel to an axis which is normal to the lengthwise axis, when said head is likewise so moved, (b) fixes one of said jaws with respect to said head and c) enables the other of said jaws to move with respect to said head along the crosswise axis and, thus, to move said movable other of said jaws towards and away from said fixed one of the jaws.

18. Apparatus according to claim 17 in which said head apparatus is operable to retract the movable other of the jaws from gripping the flange segment in a first direction;

retraction apparatus for retracting the head from the flange segment in a second direction which is opposite from the first direction, and for a distance that permits both the fixed one and movable other of the jaws to be out of contact with the flange;

indexing apparatus for indexing the panel along the lengthwise axis to position a new segment of the flange between the fixed one and movable other of the jaws;

head moving apparatus (a) for moving the head in the first direction to place the fixed one of the jaws into contact with the new flange segment, (b) for moving the movable other of the jaws in the second direction to place it in contact with the new flange segment and, with the fixed one of the jaws, to securely grip the new flange segment between the fixed one and movable other of the jaws, and for moving the jaw halves towards one another to shrink the flange segment and to effect a convex shape to the curvature, and away from one another to stretch the flange segment and to effect a concave shape to the curvature.

19. Apparatus according to claim 18 further including scissors apparatus for supporting the panel as it exits with the curvature from said grippers.

20. Apparatus according to claim 19 in which said scissors apparatus includes linkages and bars, a plurality of sets of rollers spaced apart from one another and articulation mechanisms coupled to said linkages and bars for providing said rollers with a configuration that mirrors the curvature for supporting parts of the panel.

21. Apparatus according to claim 20 further including interconnections between said scissors apparatus and said comparing apparatus for effecting the roller configuration.

* * * * *